US010627773B2

(12) United States Patent
Choi et al.

(10) Patent No.: US 10,627,773 B2
(45) **Date of Patent: *Apr. 21, 2020**

(54) IMAGE FORMING APPARATUS

(71) Applicant: HEWLETT-PACKARD DEVELOPMENT COMPANY, L.P., Spring, TX (US)

(72) Inventors: Mun Hyub Choi, Suwon-si (KR); Han Jun Lee, Goyang-si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/191,032

(22) Filed: Nov. 14, 2018

(65) Prior Publication Data

US 2019/0101861 A1 Apr. 4, 2019

Related U.S. Application Data

(63) Continuation of application No. 15/508,731, filed as application No. PCT/KR2015/004062 on Apr. 23, 2015, now Pat. No. 10,162,301.

(30) Foreign Application Priority Data

Sep. 3, 2014 (KR) ..... 10-2014-0117001

(51) Int. Cl.
*G03G 21/16* (2006.01)
*G03G 15/04* (2006.01)
(Continued)

(52) U.S. Cl.
CPC ..... *G03G 21/1633* (2013.01); *G03G 15/04* (2013.01); *G03G 15/04072* (2013.01);
(Continued)

(58) Field of Classification Search
CPC ..... G03G 21/1633; G03G 21/1647; G03G 21/1666; G03G 21/12; G03G 15/04; G03G 15/04072
See application file for complete search history.

(56) References Cited

U.S. PATENT DOCUMENTS

2005/0053394 A1 3/2005 Ishii et al.
2008/0286001 A1 11/2008 Matsumoto et al.
(Continued)

FOREIGN PATENT DOCUMENTS

EP 1515198 3/2005
EP 2444857 4/2012
(Continued)

*Primary Examiner* — Carla J Therrien
(74) *Attorney, Agent, or Firm* — Staas & Halsey LLP

(57) ABSTRACT

An image forming apparatus includes a developing device including a photosensitive unit having a photoreceptor and a developing unit having a developing. A light scanning unit including a light source may be included to generate light to form an electrostatic latent image on the photoreceptor through a window through which the light is transmitted, and shutter unit may be included to open and close the window. At least one pressing unit is provided to press the developing unit to cause the developing roller separated from the photoreceptor to contact the photoreceptor. The pressing unit may further cause the shutter unit to open and close the window. An operating unit is connected to the at least one pressing unit. The operating unit is movable between an operating position to generate a pressing force by the at least one pressing unit to press the developing unit to contact the photoreceptor and a standby position to release the pressing force.

20 Claims, 23 Drawing Sheets

(51) Int. Cl.

| | |
|---|---|
| ***G03G 15/06*** | (2006.01) |
| ***G03G 21/12*** | (2006.01) |
| ***G03G 15/08*** | (2006.01) |

(52) U.S. Cl.

CPC ..... *G03G 15/06* (2013.01); *G03G 21/12* (2013.01); *G03G 21/16* (2013.01); *G03G 21/1647* (2013.01); *G03G 21/1666* (2013.01); *G03G 15/0806* (2013.01); *G03G 21/1619* (2013.01); *G03G 2221/169* (2013.01)

(56) References Cited

U.S. PATENT DOCUMENTS

| | | | | |
|---|---|---|---|---|
| 2009/0232538 | A1* | 9/2009 | Cook ..... | G03G 15/01 399/82 |
| 2011/0142489 | A1 | 6/2011 | Yoshimura et al. | |
| 2011/0299882 | A1 | 12/2011 | Tanaami et al. | |
| 2012/0063808 | A1* | 3/2012 | Matsuda ..... | G03G 21/1647 399/111 |
| 2012/0099886 | A1 | 4/2012 | Kim | |
| 2013/0183062 | A1 | 7/2013 | Lee | |
| 2015/0117899 | A1 | 4/2015 | Yoo et al. | |
| 2015/0177640 | A1 | 6/2015 | You | |
| 2016/0059472 | A1 | 3/2016 | Lee et al. | |
| 2016/0062307 | A1 | 3/2016 | Lee | |
| 2017/0176922 | A1 | 6/2017 | Murakami et al. | |

FOREIGN PATENT DOCUMENTS

| | | |
|---|---|---|
| KR | 10-2005-0014729 | 2/2005 |
| KR | 10-2012-0088039 | 8/2012 |

* cited by examiner

[Fig. 4a]
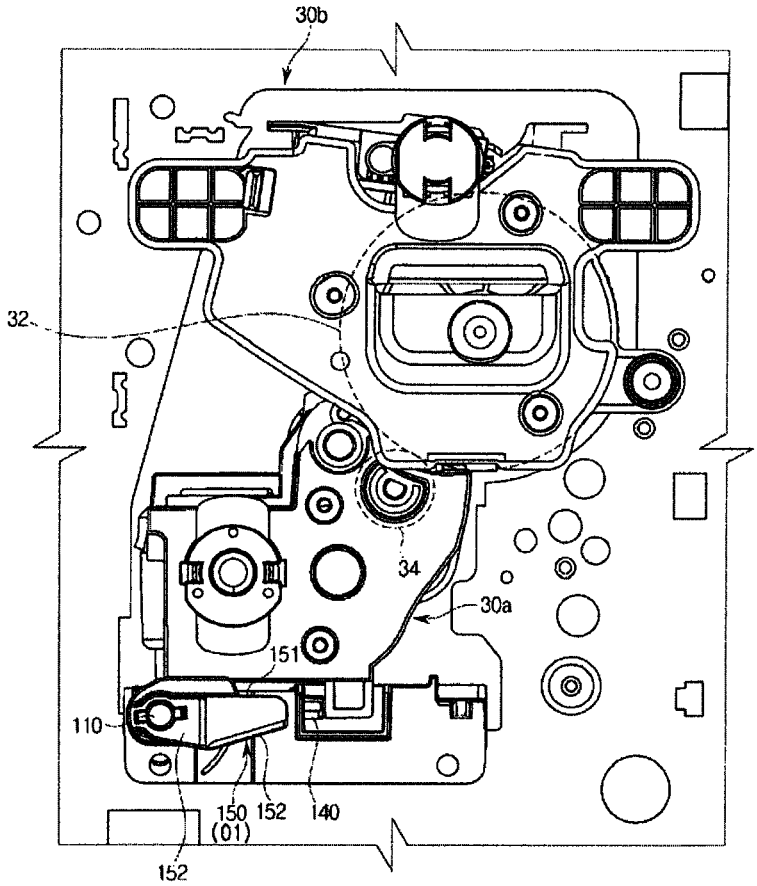

[Fig. 4b]
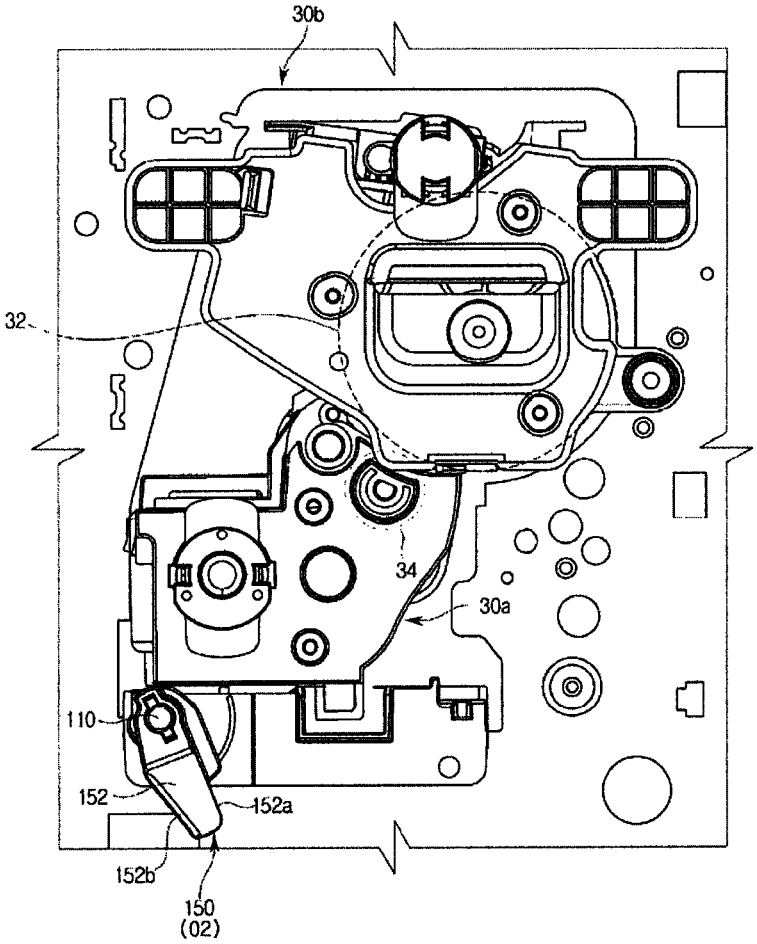
[Fig. 5a]
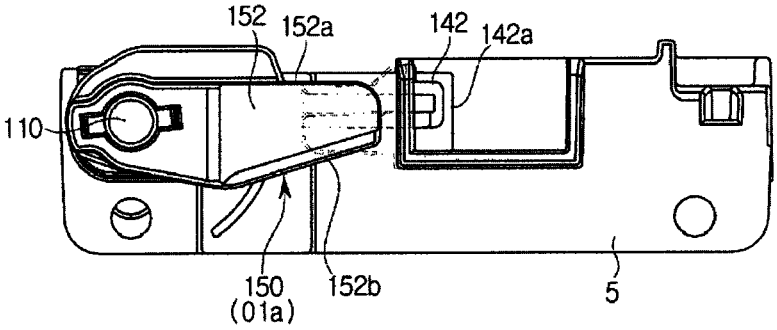

[Fig. 5b]
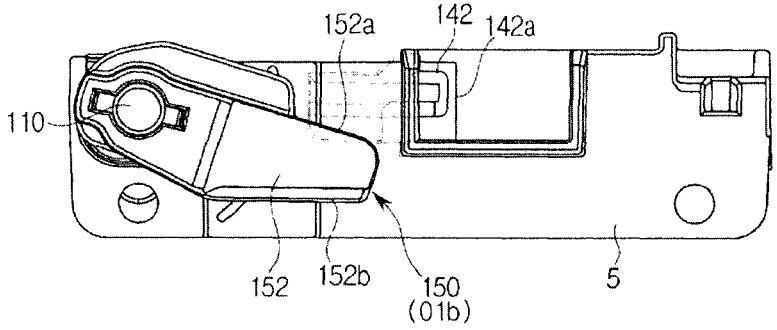
[Fig. 5c]
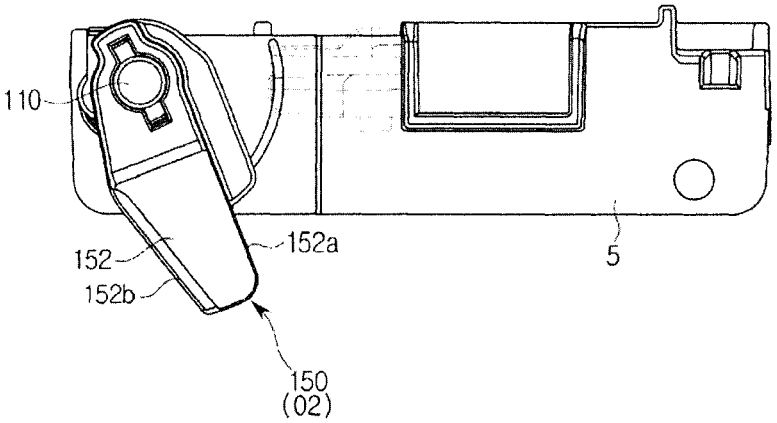
[Fig. 6a]
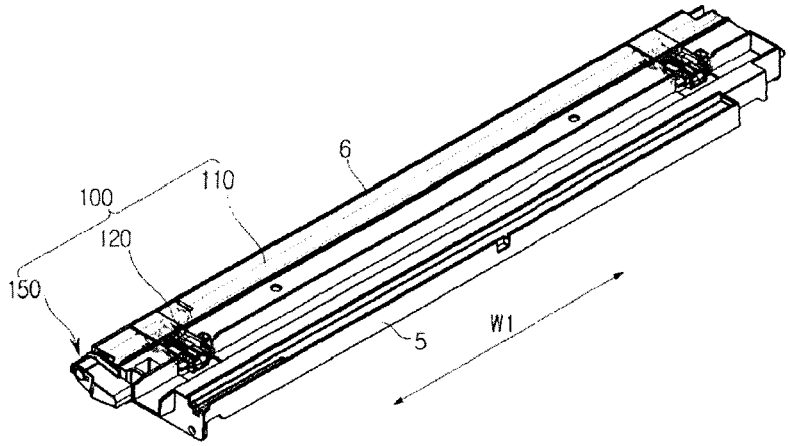

[Fig. 6b]
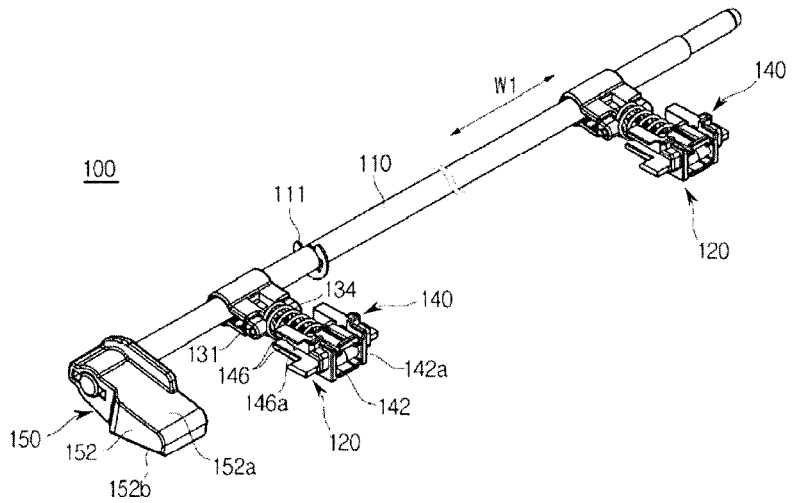
[Fig. 7a]
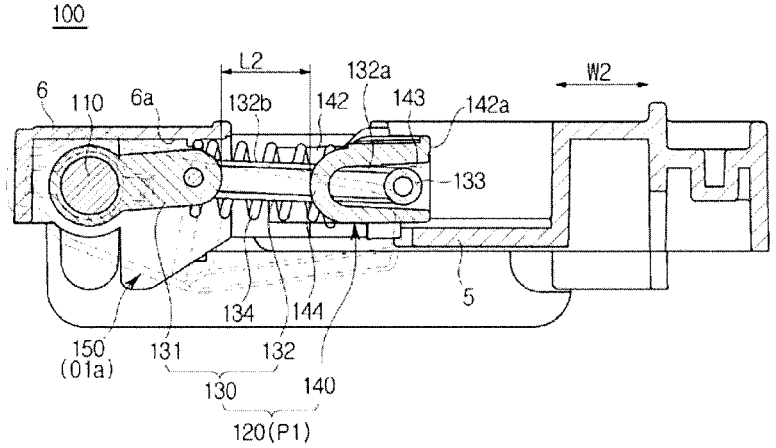
[Fig. 7b]
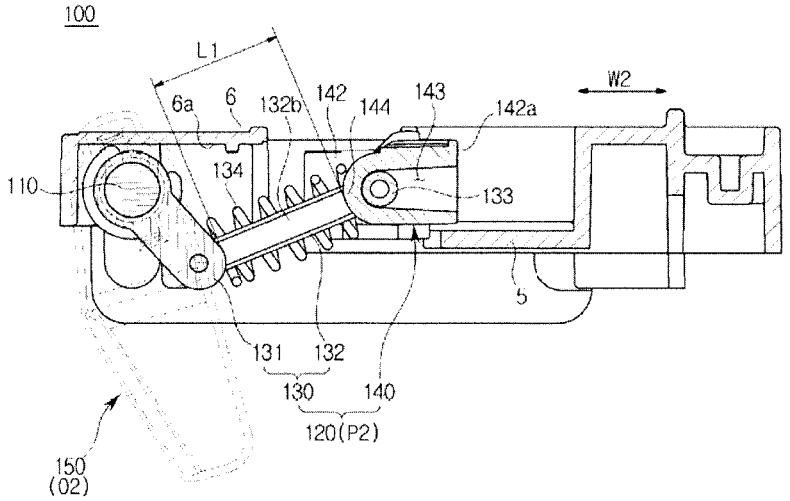

[Fig. 7c]
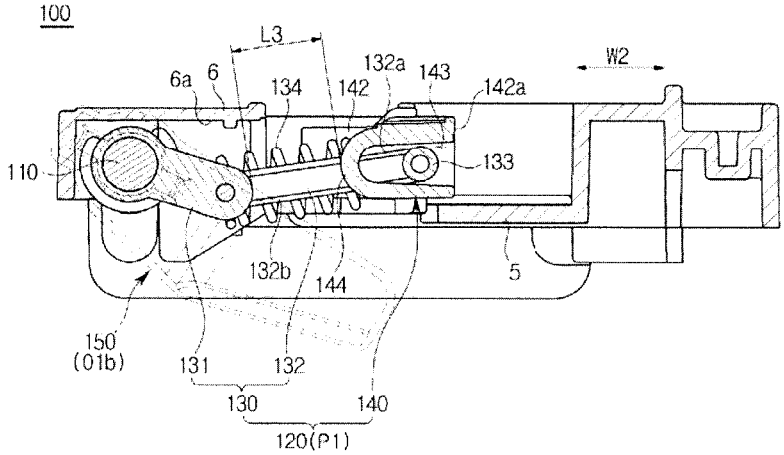
[Fig. 8a]
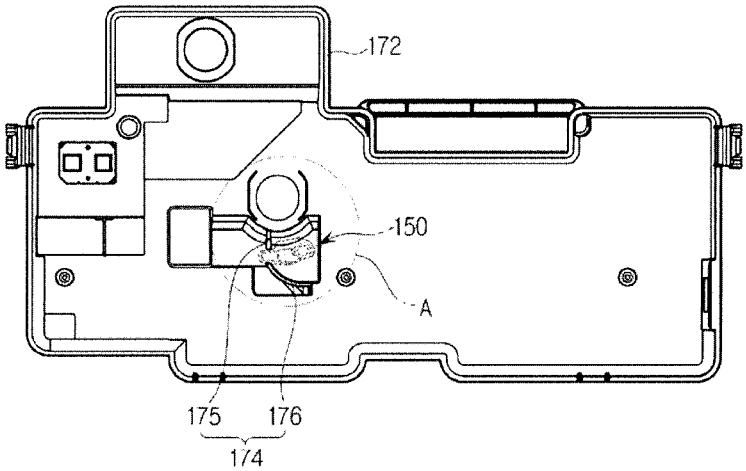

[Fig. 8b]
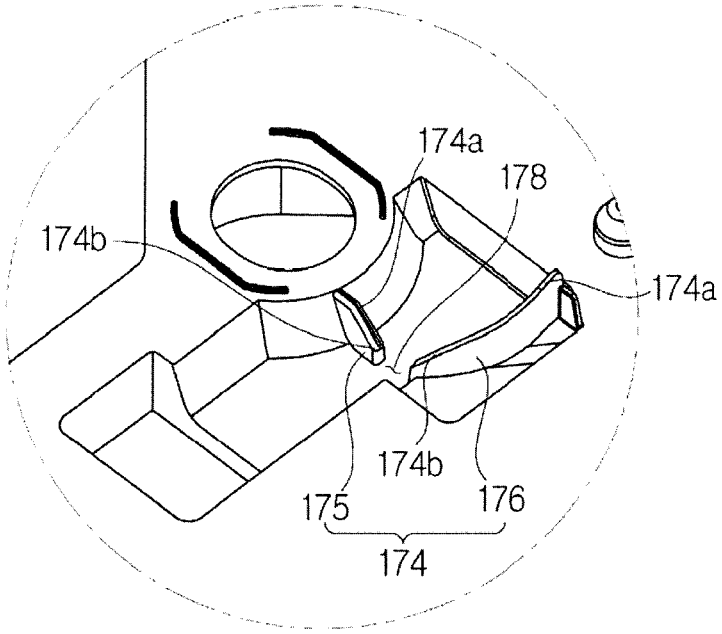
[Fig. 9]
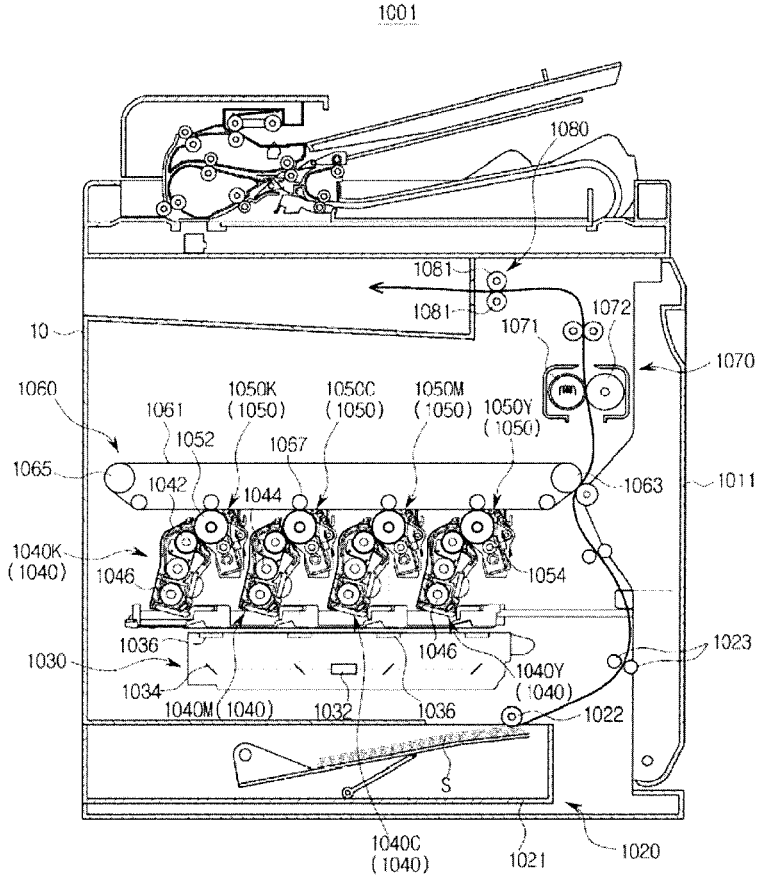

[Fig. 10]
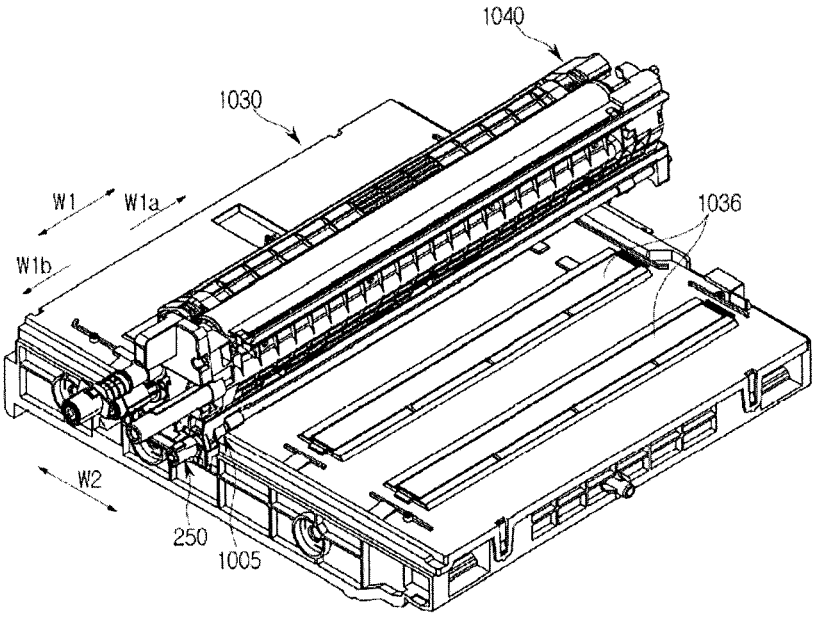
[Fig. 11a]
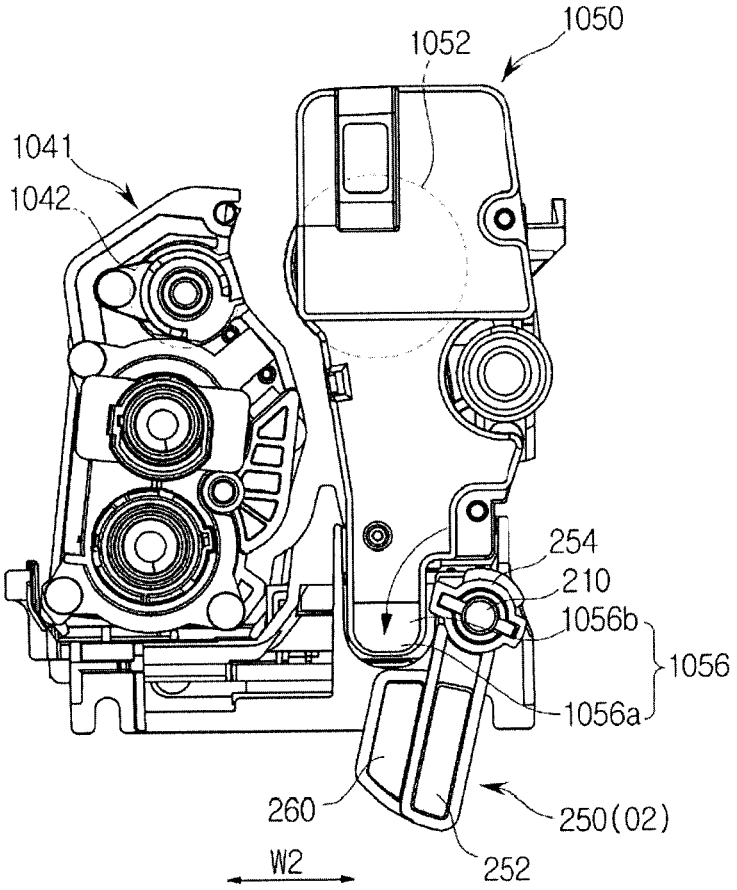

[Fig. 11b]
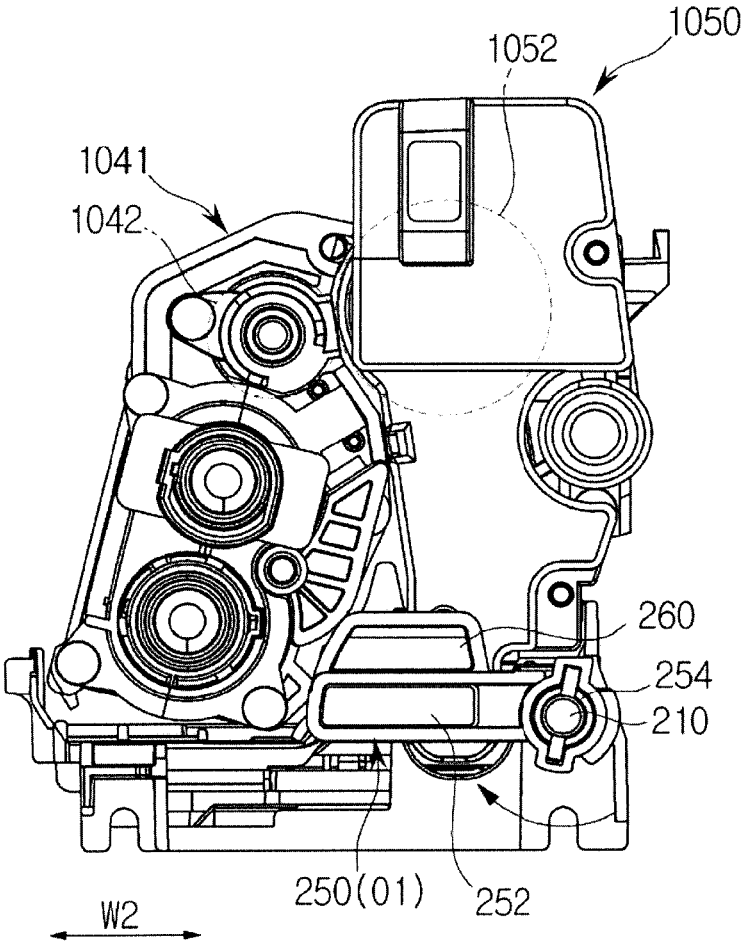
[Fig. 12a]
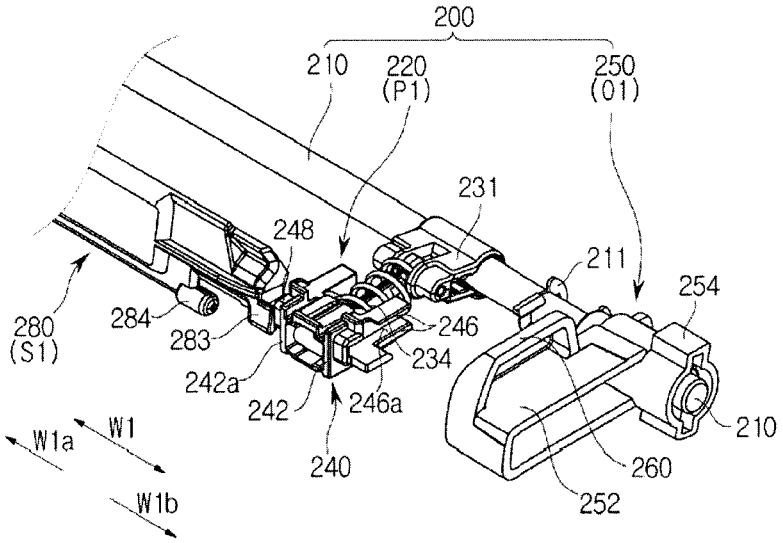

[Fig. 12b]
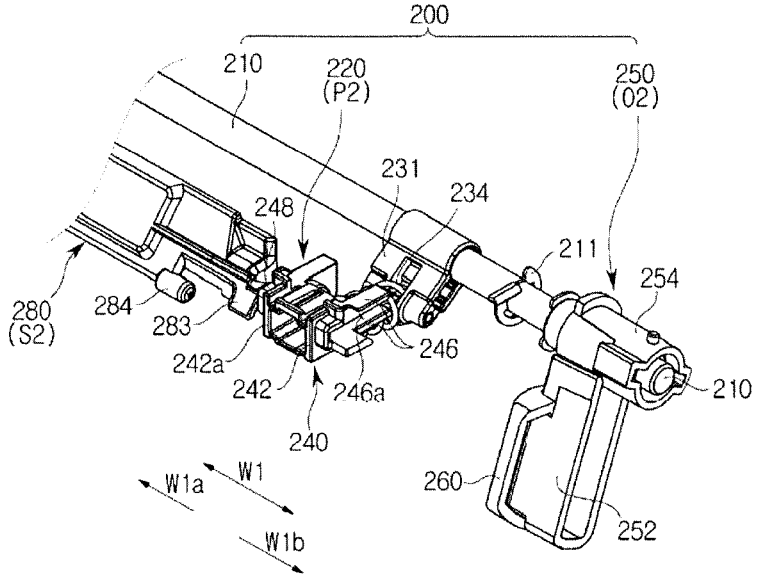
[Fig. 13a]
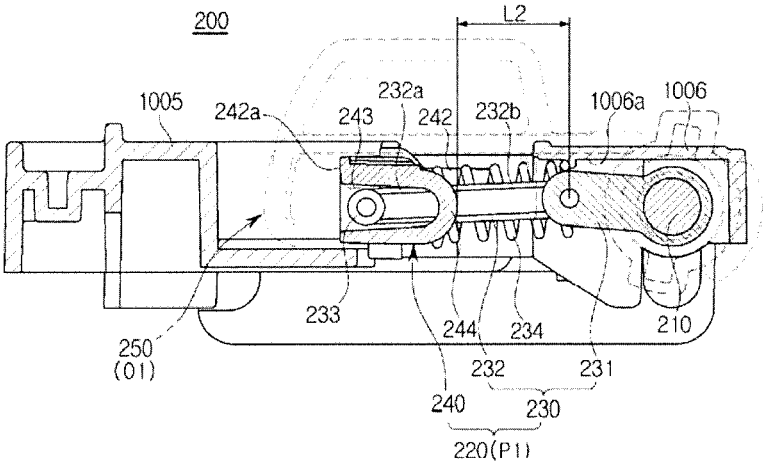

[Fig. 13b]
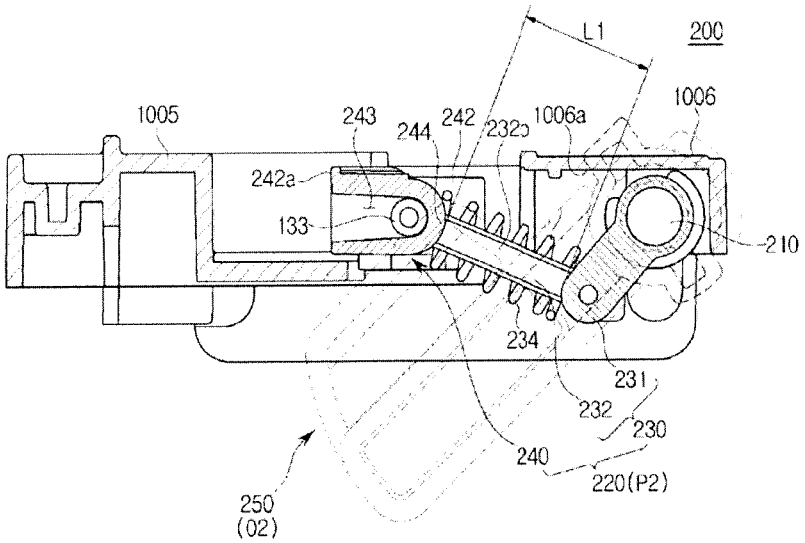
[Fig. 14a]
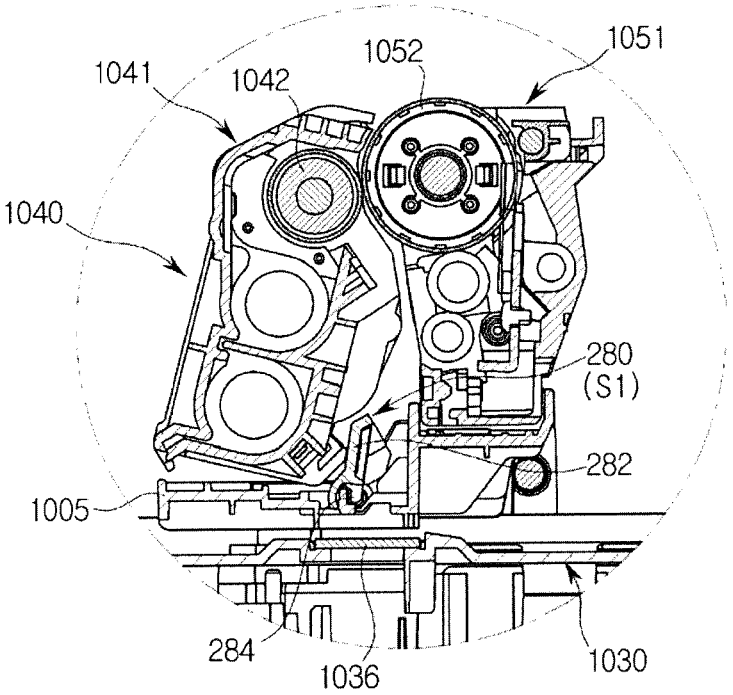

[Fig. 14b]
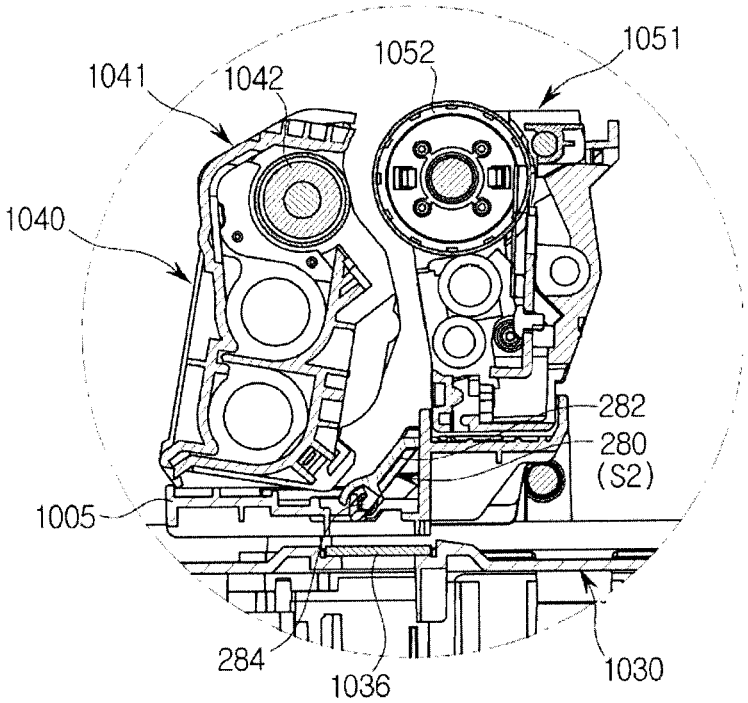
[Fig. 15]
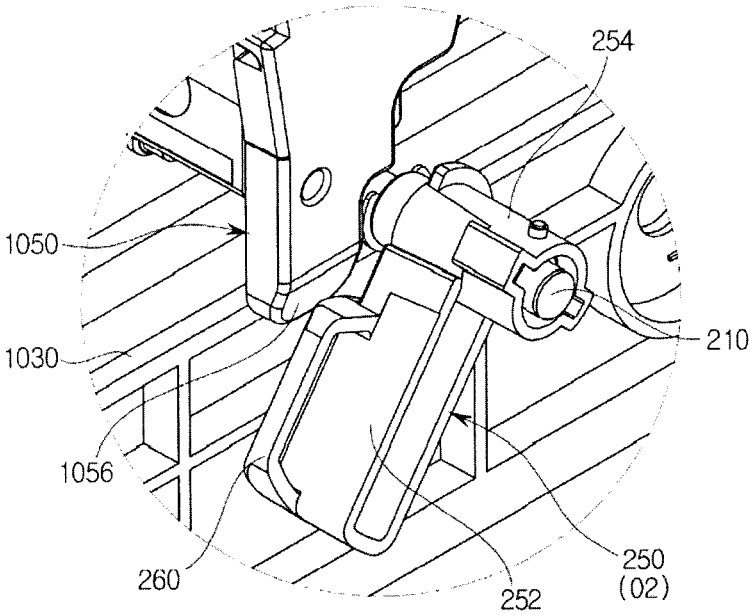

[Fig. 16]
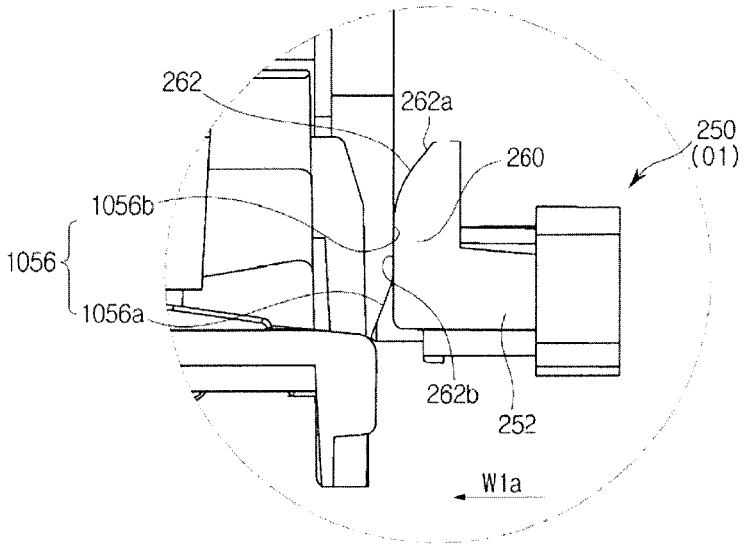
[Fig. 17]
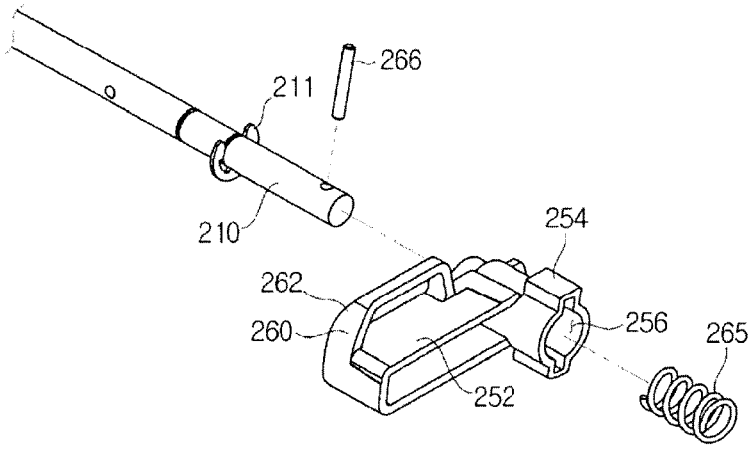

[Fig. 18]
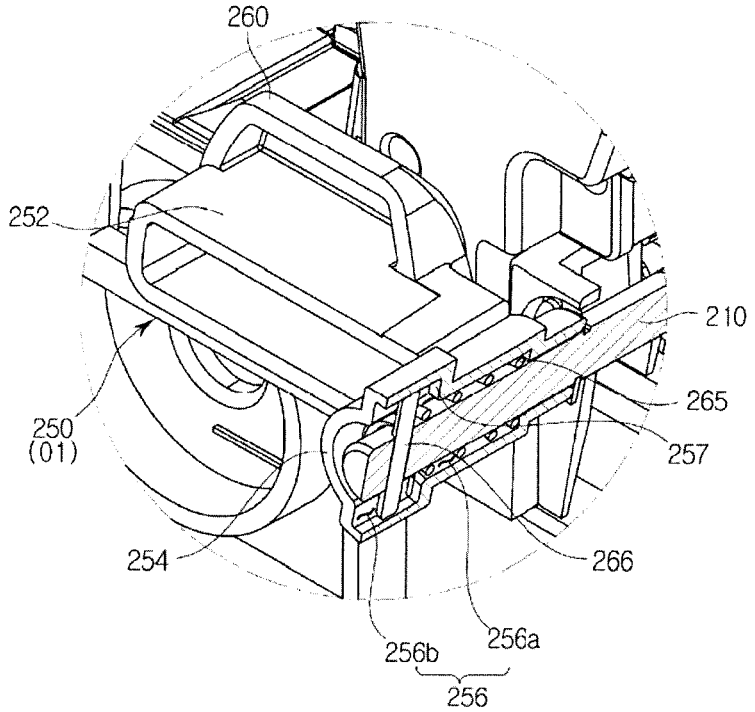
[Fig. 19]
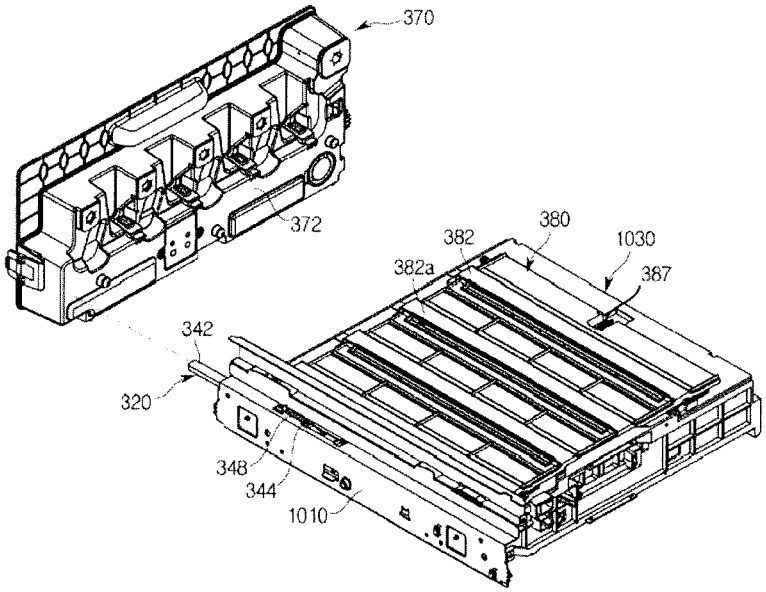
[Fig. 20]
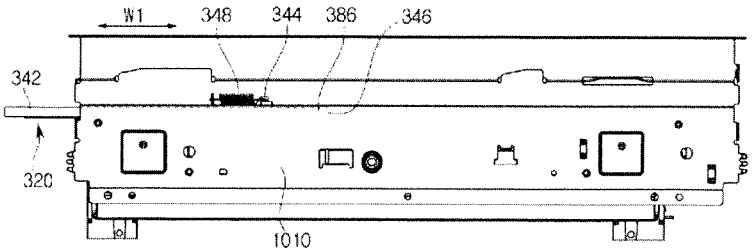

[Fig. 21]
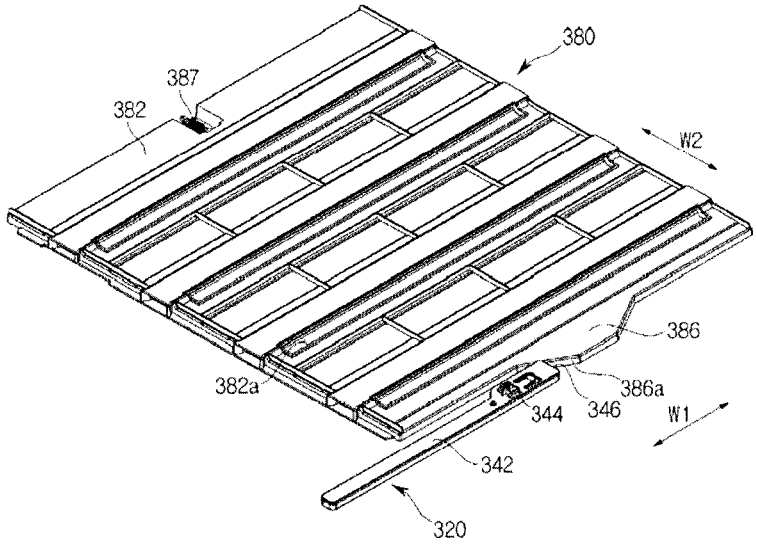
[Fig. 22a]
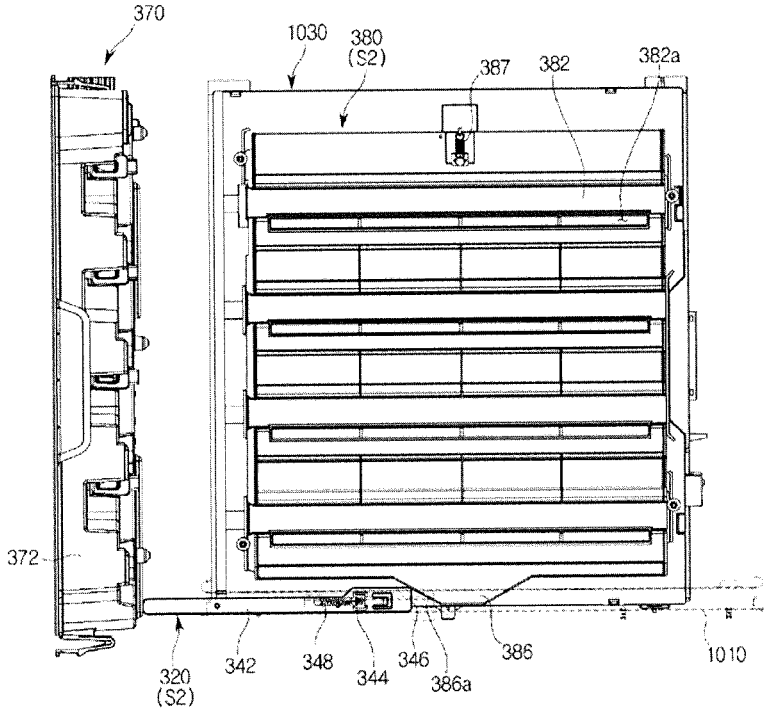

[Fig. 22b]
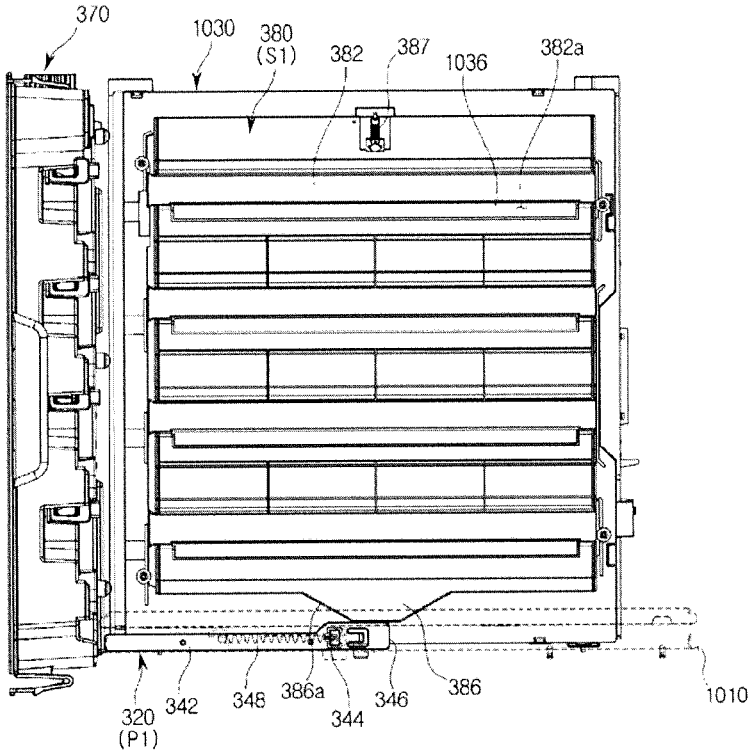

[Fig. 24a]
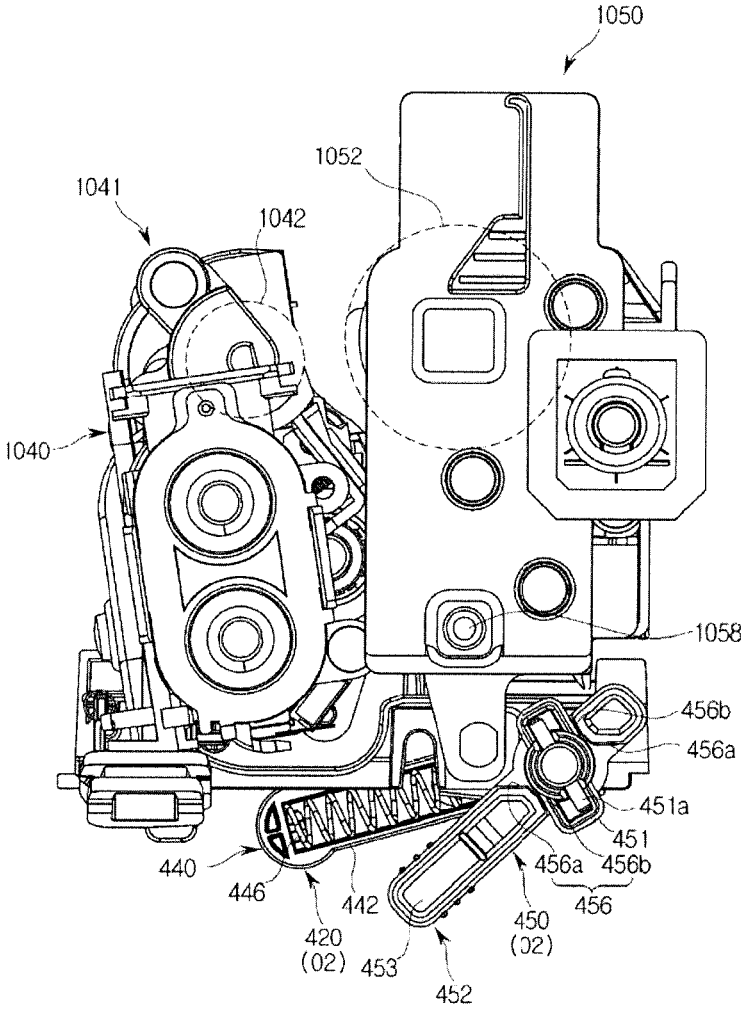

[Fig. 24b]
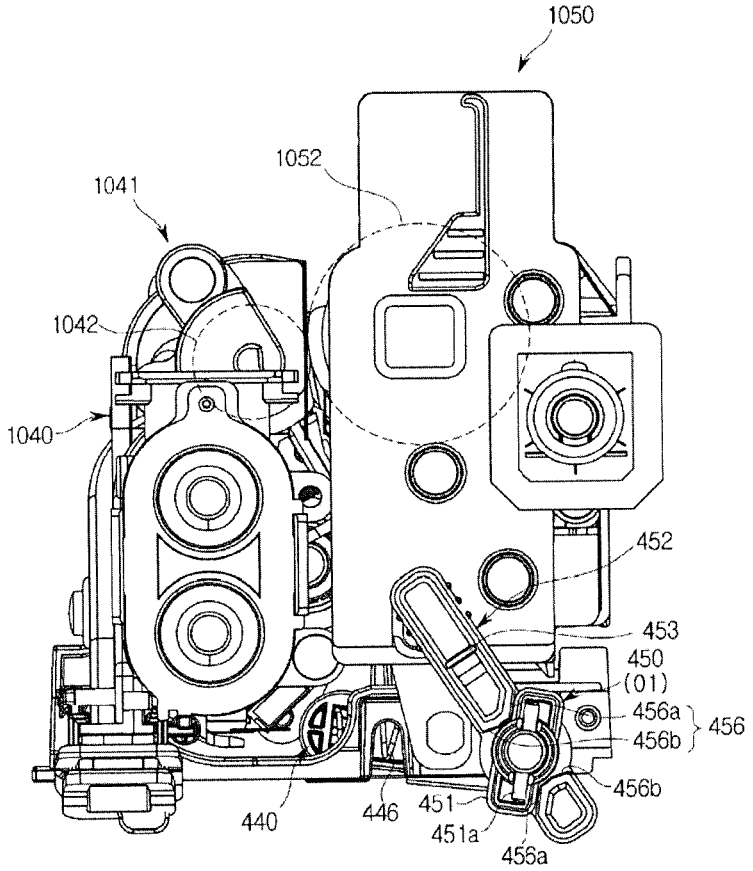
[Fig. 25a]
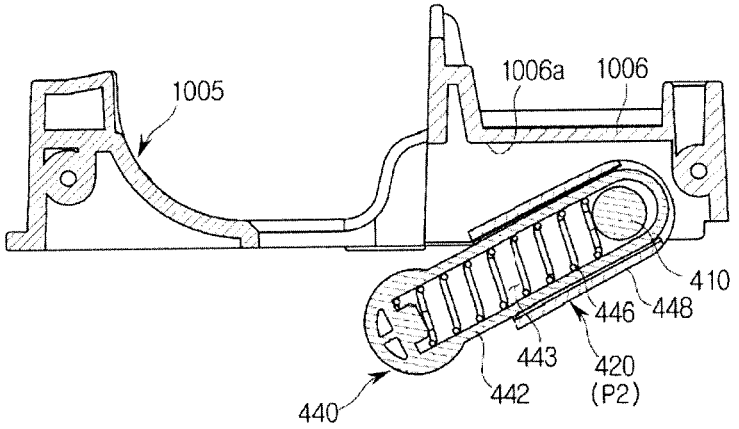

[Fig. 27a]
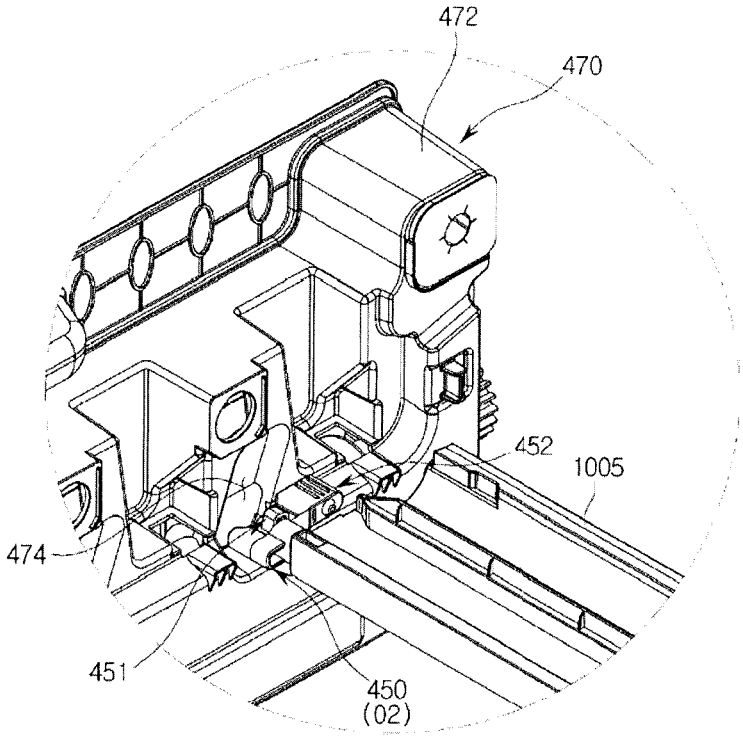
[Fig. 27b]
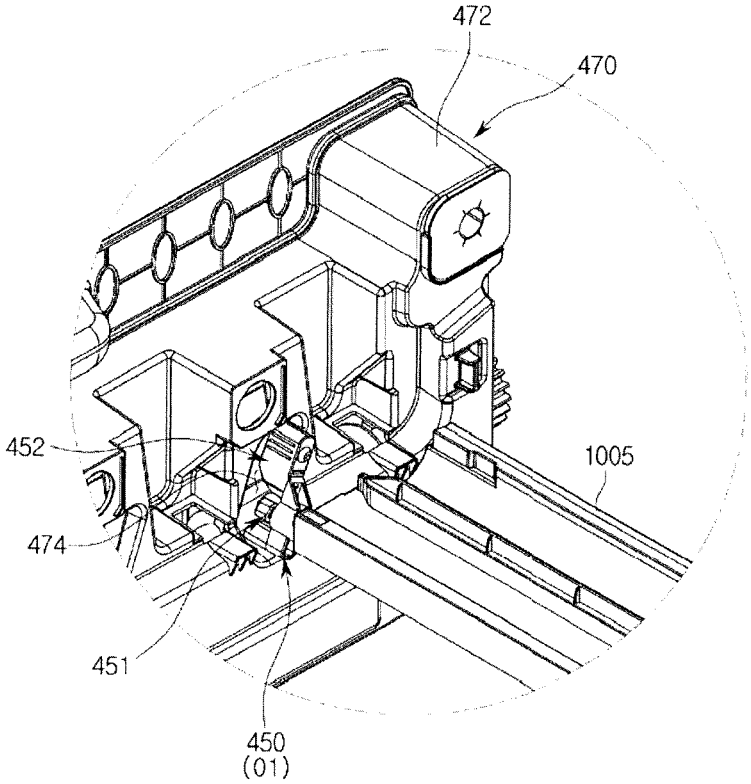

IMAGE FORMING APPARATUS

CROSS-REFERENCE TO RELATED APPLICATIONS

This application is a continuation patent application of U.S. patent application Ser. No. 15/508,731, filed on Jun. 29, 2017, which is a US national stage application claiming the benefit under 35 USC 371 of PCT International Patent Application no. PCT/KR2015/004062, filed Apr. 23, 2015, which claims priority from Korean Patent Application No. 10-2014-0117001 filed Sep. 3, 2014 in the Korean Intellectual Property Office, the entire disclosures of which are incorporated herein by reference.

TECHNICAL FIELD

Embodiments of the present invention relate to an image forming apparatus, and more particularly, an image forming apparatus having an improved structure of a shutter which opens and closes a window.

BACKGROUND ART

Image forming apparatuses are devices for forming images on printing media according to input signals, and examples thereof include printers, copiers, facsimiles, and all-in-one devices implemented by a combination thereof.

One type of image forming apparatus, an electrophotographic image forming apparatus, includes a photosensitive unit having a photoreceptor therein, a charging unit which is disposed near the photosensitive unit and charges the photoreceptor to a predetermined potential level, a developing unit having a developing roller, and a light scanning unit. The light scanning unit applies light onto the photoreceptor charged to the predetermined potential level by the charging unit to form an electrostatic latent image on a surface of the photoreceptor, and the developing unit supplies developers onto the photoreceptor, on which the electrostatic latent image is formed to form a visible image.

In the case of the image forming apparatus having a structure in which a developing roller is in contact with a photoreceptor to supply a developer, the developing roller and the photoreceptor have to be in contact with each other when a printing operation is performed, and the developing roller and the photoreceptor have to be separated from each other to prevent interference between the developing roller and the photoreceptor when the developing unit is replaced.

DISCLOSURE

Technical Problem

However, there are problems such as damage to the developing unit or photoreceptor caused by replacing the developing unit in a state in which the developing roller is in contact with the photoreceptor, generation of image defects caused by operating the image forming apparatus in a state in which the developing roller is separated from the photoreceptor, etc.

Technical Solution

Therefore, it is an aspect of the present invention to provide an image forming apparatus having an improved structure to open a light scanning unit when a developing unit is in contact with a photosensitive unit.

Additional aspects of the invention will be set forth in part in the description which follows and, in part, will be obvious from the description, or may be learned by practice of the invention.

In accordance with one aspect of the present invention, an image forming apparatus includes a main body; a developing device including a photosensitive unit having a photoreceptor, and a developing unit which has a developing roller provided on the photoreceptor to be attachable or detachable and is provided adjacent to the photosensitive unit; a light scanning unit including a light source which generates light to form an electrostatic latent image by applying the light onto the photoreceptor, and a window through which the light generated by the light source is transmitted; a shutter unit which opens and closes the window; a plurality of pressing units which are provided to be pressable the developing unit and the shutter unit to perform an operation of attaching or detaching the developing roller to or from the photoreceptor and an operation of opening and closing the shutter unit and are disposed to be spaced in a longitudinal direction of the developing unit; and an operating unit movably provided between an operating position at which a pressing force of the plurality of pressing units is generated, and a standby position at which the pressing force is released.

The plurality of pressing units may be formed to perform an operation of pressing the shutter unit together with an operation of pressing the developing unit.

The plurality of pressing units may operate in linkage with the operating unit.

The plurality of pressing units may operate at a pressing position which corresponds to the operating position of the operating unit and at which the developing unit and the shutter unit are pressed, and a release position which corresponds to the standby position of the operating unit and at which pressure is released from the pressing position; and the plurality of pressing units may each include a pressing elastic member which generates a pressing force at the pressing position.

The plurality of pressing units may each include a pressing body which presses the developing unit to adhere the developing roller and the photoreceptor to each other and a pressing part having a shutter guide protrusion provided on the pressing body to operate the shutter unit.

The plurality of pressing units may each include a pair of pressing units and the shutter guide protrusion of the pair of pressing units may be provided to press both ends of the shutter unit.

The image forming apparatus may further include a rotating shaft which forms a center of rotation of the operating unit, wherein the plurality of pressing units may be disposed on the rotating shaft to be spaced apart from each other.

The image forming apparatus may further include a rotating shaft which forms a center of rotation of the operating unit, wherein the plurality of pressing units may each include a link unit which converts a rotational motion of the rotating shaft by rotation of the operating unit into a linear motion, and a pressing part which is connected to the link unit to press the developing device.

The link unit may include a first link member rotated with the rotating shaft, and a second link member with one end connected to an end portion of the first link member and the other end performing a linear reciprocating motion.

The link unit may include a pressing elastic member provided on the second link member to generate a pressing force of the pressing unit.

The second link member may include a hook inserting part, at least a part of which is inserted into the pressing part according to a position of the pressing unit; and a flexible mounting part disposed adjacent to the hook inserting part, and configured to mount the pressing elastic member, wherein a length of the pressing elastic member may be changed in linkage with a pressing force such that the pressing force of the pressing elastic member is changed.

One end of the pressing elastic member may be supported by an end portion of the second link member and the other end thereof may be supported by the pressing part.

The pressing elastic member may be compressed to a maximum compression length (ML) when the operating unit is disposed between the operating position and the standby position.

The operating unit may restrict movement of the developing device in the longitudinal direction at the operating position.

The image forming apparatus may further includes a developing device mounting part on which the photosensitive unit and the developing unit are mounted and into which the photosensitive unit and the developing unit are inserted in a longitudinal direction, wherein the operating unit and the pressing unit may be disposed on the developing device mounting part.

The shutter unit may include a shutter body which corresponds to the window and is provided to be capable of rotating about a shutter rotating part formed in a longitudinal direction of the shutter body from one side of the shutter body.

The shutter unit may include an open position at which the window is opened, and a closed position at which the window is closed; and the shutter body may be rotated with an acute angle between the open position and the closed position.

The shutter unit may be moved from the closed position to the open position by the pressing assembly and moved from the open position to the closed position by a weight of the shutter body.

The operating unit includes an operating body rotatably provided on an end portion of the rotating shaft, and a mounting pressing member provided on one side of the operating body to press the developing device.

The mounting pressing member may be more convexly formed than the adjacent operating body.

The developing device may be formed in a first direction which is a longitudinal direction; the first direction may include a mounting direction in which the developing device is mounted on the developing device mounting part, and a detachment direction, opposite the mounting direction, in which the developing device is separated from the developing device mounting part; and the mounting pressing member may include a first mounting pressing part which is in contact with the developing device while the operating unit moves from the standby position to the operating position; and a second mounting pressing part formed to extend from the first mounting pressing part, wherein the operating unit may be in contact with the developing device at the operating position and the second mounting pressing part protrudes in the mounting direction more than protrusion of the first mounting pressing part.

The developing device may be formed in a first direction which is a longitudinal direction; the first direction includes a mounting direction in which the developing device is mounted on the developing device mounting part, and a detachment direction, opposite the mounting direction, in which the developing device is separated from the developing device mounting part; and the photosensitive unit may include a mounting pressurized surface formed to be sloped to press the photosensitive unit in the mounting direction by the operating unit while the operating unit moves from the standby position to the operating position.

In accordance with another aspect of the present invention, an image forming apparatus includes a main body; a developing device including a photosensitive unit having a photoreceptor and a developing unit which has a developing roller and is adjacent to the photosensitive unit; a light scanning unit including a light source which generates light to form an electrostatic latent image by applying the light onto the photoreceptor, and a window through which the light generated by the light source is transmitted; a pressing assembly including an operating unit rotatably provided and a plurality of pressing units which press the developing unit to adhere the developing roller and the photoreceptor to each other and operate in linkage with the operating unit; and a shutter unit which opens and closes the window and operates in linkage with the operating unit, wherein the plurality of pressing units include a pressing position at which the developing unit is pressed to adhere the developing roller and the photoreceptor to each other, and a release position at which pressure on the developing unit is released by moving back from the pressing position, the shutter unit includes an open position at which the window is opened, and a closed position at which the window is closed by rotation from the open position, and the operating unit includes an operating position at which the plurality of pressing units are moved to the pressing position and the shutter unit is moved to the open position, and a standby position at which the plurality of pressing units are moved to the release position and the shutter unit is moved to the closed position.

The shutter unit may include a shutter body which corresponds to the window and is provided to be capable of rotating about a shutter rotating part formed in a longitudinal direction of the shutter body from one side of the shutter body.

The shutter unit may include an open position at which the window is opened, and a closed position at which the window is closed; and the shutter body may be rotated with an acute angle between the open position and the closed position.

The shutter unit may be moved from the closed position to the open position by the pressing assembly and moved from the open position to the closed position by a weight of the shutter body.

The image forming apparatus may further include a rotating shaft which forms a center of rotation of the operating unit, wherein the plurality of pressing units may be disposed on the rotating shaft to be spaced apart from each other.

The image forming apparatus may further include a rotating shaft which forms a center of rotation of the operating unit, wherein the plurality of pressing units may each include a link unit which converts a rotational motion of the rotating shaft by rotation of the operating unit into a linear motion; and a pressing part which is connected to the link unit to press the developing device.

The link unit may include a first link member rotated with the rotating shaft; and a second link member with one end connected to an end portion of the first link member and the other end performing a linear reciprocating motion.

The link unit may include a pressing elastic member provided on the second link member to generate a pressing force of the pressing unit.

The second link member may include a hook inserting part, at least a part of which is inserted into the pressing part according to a position of the pressing unit; and a flexible mounting part disposed adjacent to the hook inserting part, and configured to mount the pressing elastic member and change a length of the pressing elastic member to change in linkage with a pressing force of the pressing elastic member.

One end of the pressing elastic member may be supported by an end portion of the second link member and the other end may be supported by the pressing part.

The pressing elastic member may be compressed to a maximum compression length (ML) when the operating unit is disposed between the operating position and the standby position.

In accordance with still another aspect of the present invention, an image forming apparatus includes a main body; a developing device including a photoreceptor and a developing roller which is in contact with the photoreceptor on which an electrostatic latent image is formed, supplies a developer, and provided to be detachable from the photoreceptor; a light scanning unit including a light source which generates light to form an electrostatic latent image by applying the light onto the photoreceptor, and at least one window through which the light generated by the light source is transmitted; a shutter unit which has at least one shutter hole corresponding to the at least one window, and moves between an open position at which the at least one window is opened, and a closed position at which the at least one window is close by moving from the open position; a pressing unit which presses the shutter unit to move the shutter unit between the open position and the closed position; and a cover unit which is provided to be detachable on one side of the developing device to press the pressing unit to link with the shutter unit.

The pressing unit may be movably provided in a first direction which is a longitudinal direction of the developing device; and the shutter unit may move between the open position and the closed position in a second direction perpendicular to the first direction.

Advantageous Effects

As is apparent from the above description, since the image forming apparatus is provided to link with an operation of attachment or detachment of the developing roller and photoreceptor through attachment or detachment of the cover unit, malfunction of the image forming apparatus can be prevented.

DESCRIPTION OF DRAWINGS

FIGS. 4A and 4B are views illustrating an operation of a pressing assembly and a developing unit according to the first embodiment of the present invention;

FIGS. 5A, 5B, and 5C are views illustrating the operation of the pressing assembly according to the first embodiment of the present invention;

FIGS. 6A and 6B are perspective views illustrating the pressing assembly according to the first embodiment of the present invention;

FIGS. 7A, 7B, and 7C are cross-sectional views of a pressing unit based on the operation of the pressing assembly according to the first embodiment of the present invention;

FIG. 8A is a view illustrating the cover unit according to the first embodiment of the present invention;

FIG. 8B is an enlarged view of a portion A shown in FIG. 8A;

FIG. 9 is a cross-sectional view of an image forming apparatus according to a second embodiment of the present invention;

FIG. 10 is a view illustrating an arrangement of a developing device and a light scanning unit of the image forming apparatus according to the second embodiment of the present invention;

FIGS. 11A and 11B are views illustrating an operation of a pressing assembly and the developing device according to the second embodiment of the present invention;

FIGS. 12A and 12B are perspective views illustrating the operation of the pressing assembly according to the second embodiment of the present invention;

FIGS. 13A and 13B are cross-sectional views of a pressing unit based on the operation of the pressing assembly according to the second embodiment of the present invention;

FIGS. 14A and 14B are cross-sectional views illustrating a shutter unit and the developing device based on the operation of the pressing assembly according to the second embodiment of the present invention;

FIG. 15 is a perspective view illustrating a position of an operating unit according to the second embodiment of the present invention;

FIG. 16 is a side view illustrating a pressed state of the operating unit according to the second embodiment of the present invention;

FIG. 17 is an exploded perspective view of the operating unit in the pressing assembly according to the second embodiment of the present invention;

FIG. 18 is a cross-sectional perspective view illustrating the operating unit according to the second embodiment of the present invention;

FIG. 19 is a view illustrating an arrangement of a developing device and a cover unit of an image forming apparatus according to a third embodiment of the present invention;

FIG. 20 is a front view of a pressing unit according to the third embodiment of the present invention;

FIG. 21 is a perspective view illustrating the pressing unit and a shutter unit according to the third embodiment of the present invention;

FIGS. 22A and 22B are views illustrating a linking operation of the pressing unit, the shutter unit, and the cover unit according to the third embodiment of the present invention;

FIGS. 24A and 24B are views illustrating an operation of a pressing assembly and the developing device according to the fourth embodiment of the present invention;

FIGS. 25A and 25B are cross-sectional views of a pressing unit based on the operation of the pressing assembly according to the fourth embodiment of the present invention;

FIGS. 27A and 27B are views illustrating mountability of the developing device of the cover unit based on the operation of the pressing assembly according to the fourth embodiment of the present invention.

BEST MODE

Figure 1:
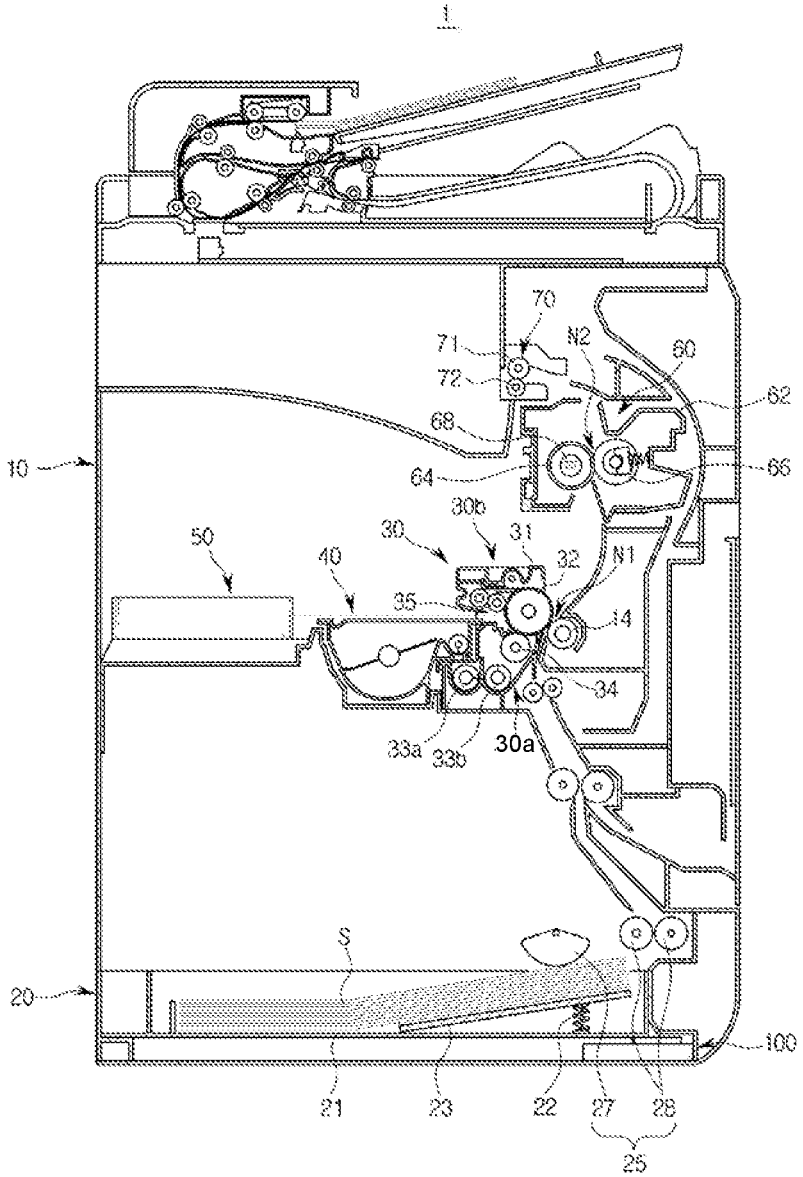
FIG. 1 is a cross-sectional view of an image forming apparatus according to a first embodiment of the present invention.

These and/or other aspects of the invention will become apparent and more readily appreciated from the following description of the embodiments, taken in conjunction with the accompanying drawings of which:

DETAILED DESCRIPTION

Reference will now be made in detail to the embodiments of the present invention, examples of which are illustrated in the accompanying drawings, wherein like reference numerals refer to like elements throughout.

An image forming apparatus according to the first embodiment of the present invention will be described.

FIG. 1 is a cross-sectional view of an image forming apparatus according to a first embodiment of the present invention.

As shown in FIG. 1, an image forming apparatus 1 includes a main body 10, a printing medium supply device 20 for storing and delivering a printing medium S, a developing device 30 which forms an image on the printing medium S supplied by the printing medium supply device 20, a toner device 40 which supplies toner to the developing device 30, a light scanning device 50 which forms an electrostatic latent image on a photoreceptor 32 of the developing device 30, a fixing device 60 which fixes the transferred toner image to the printing medium S, and an ejecting device 70 which ejects the printing medium S on which the image is completely formed to the outside of the main body 10.

The printing medium supply device 20 serves to store and deliver the printing medium S and is provided at lower portion of the main body 10 to supply the printing medium S toward the developing device 30.

The printing medium supply device 20 may include a printing medium cassette 21, which is able to open and close and coupled with the main body 10, for storing the printing medium S, and a feeding member 25 which picks up the printing medium S stored in the printing medium cassette 21 one sheet at a time and delivers the printing medium S to the developing device 30.

In the printing medium cassette 21, a knock-up plate 23, one end of which is rotatably coupled to guide the stacked printing medium S to the feeding member 25 and the other end of which is supported by a pressing spring 22, may be provided.

The feeding member 25 may include a pick-up roller 27, which picks up the printing medium S stacked on the knock-up plate 23 one sheet at a time, and a feeding roller 28 which delivers the printing medium S picked up by the pick-up roller 27 to the device 30.

The developing device 30 includes a housing 31 which forms an exterior thereof, a photoreceptor 32 which is rotatably coupled inside the housing 31 and forms an electrostatic latent image, stir screws 33*a* and 33*b* which stir the toner supplied from the toner device 40, a developing roller 34 which supplies the toner stirred by the stir screws 33*a* and 33*b* to the photoreceptor 32, and a charging member 35 which charges the photoreceptor 32.

The toner supplied from the toner device 40 flows into the housing 31 and is stirred and delivered to one side of the housing 31 by the stir screws 33*a* and 33*b*, and the stirred and delivered toner is supplied to the photoreceptor 32 by the developing roller 34 to form a visible image.

The photoreceptor 32 is in contact with the transfer roller 14 to form a transfer nip N1 for transferring the toner, which is supplied to the photoreceptor 32 to form the visible image, to the printing medium S. The transfer roller 14 is rotatably disposed inside the main body 10.

The toner device 40 is coupled with the developing device 30, accommodates and stores the toner which forms the image on the printing medium S, and supplies the toner to the developing device 30 when an image forming operation is performed.

The light scanning device 50 applies light having image information to the photoreceptor 32 to form an electrostatic latent image on the photoreceptor 32.

The fixing device 60 is formed to include a housing 62, and a heating member 64 and a pressing member 66 which are rotatably disposed inside the housing 62.

The printing medium S, to which the toner image is transferred, passes between the heating member 64 and the pressing member 66, and the toner image is simultaneously fixed on the printing medium S by heat and pressure.

The heating member 64 is rotated with the interlocked pressing member 66, forms a fixing nip N2 together with the pressing member 66, and is heated by a heat source 68 to transfer the heat to the printing medium S which passes through the fixing nip N2. The heating member 64 may be formed with a heating roller rotated by receiving driving power from a driving source (not shown). The heat source 68 is disposed inside the heating member 64 to apply heat to the printing medium S to which the toner is transferred. A halogen lamp may be used for the heat source 68, but various types, such as an electrothermal wire, an induction heater, etc., may also be applied.

The pressing member 66 is disposed to be in contact with an outer circumferential surface of the heating member 64 and the fixing nip N2 is formed between the pressing member 66 and the heating member 64. The heating member 64 may be formed with a pressing roller rotated by receiving driving power from a driving source (not shown).

The ejecting device 70 includes a first ejecting roller 71 interlocked with a second ejecting roller 72 and ejects the printing medium S passed through the fixing device 60 to the outside of the main body 10.

Figure 2:
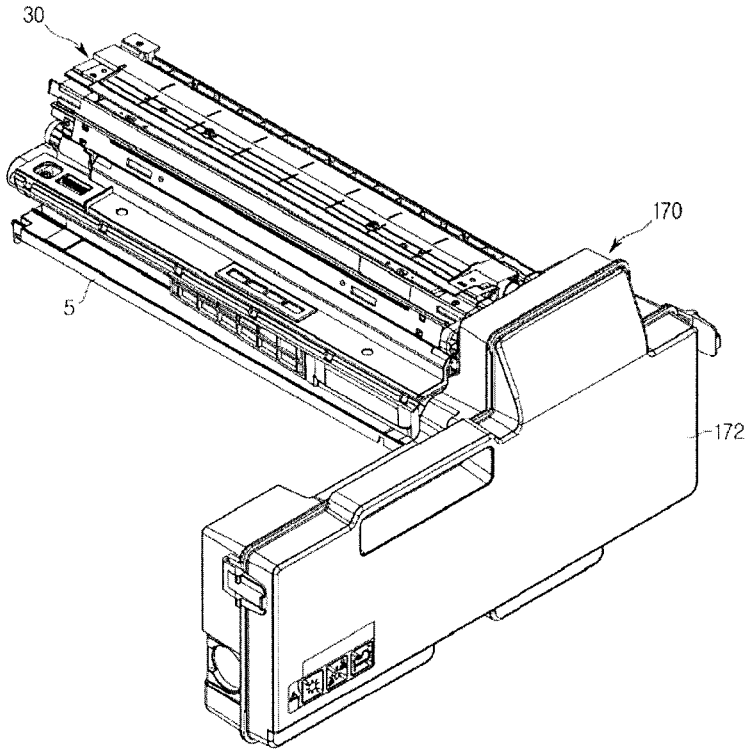
FIG. 2 is a view illustrating a developing device and a cover unit of the image forming apparatus according to the first embodiment of the present invention.
Figure 3:
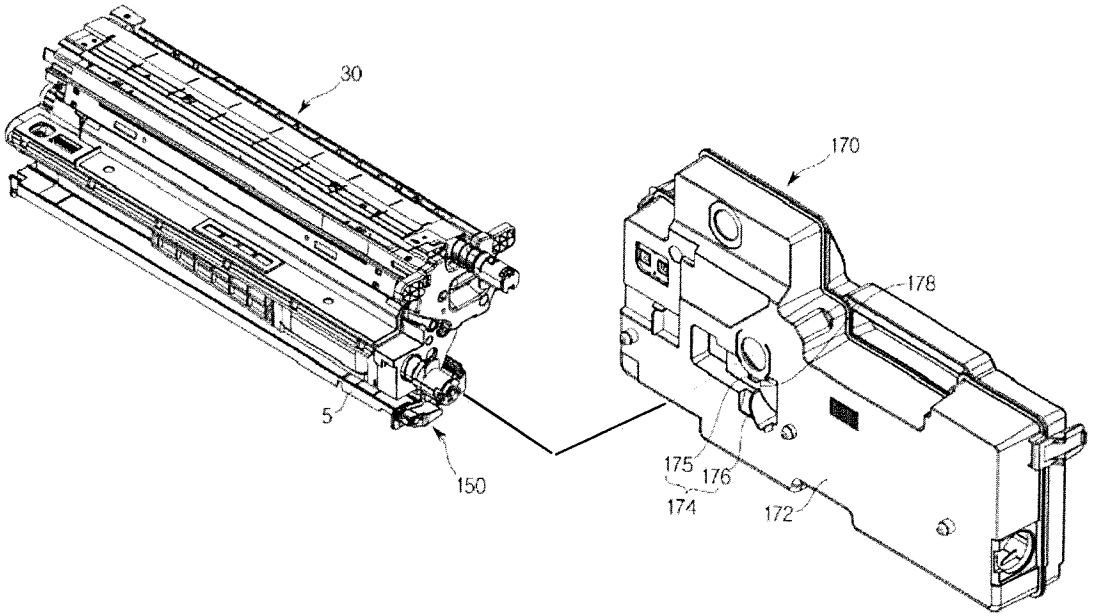
FIG. 3 is a view illustrating a combination of the developing device and the cover unit of the image forming apparatus according to the first embodiment of the present invention.

FIG. 2 is a view illustrating the developing device and a cover unit of the image forming apparatus according to the first embodiment of the present invention, and FIG. 3 is a view illustrating a combination of the developing device and the cover unit of the image forming apparatus according to the first embodiment of the present invention.

The developing device 30 may be mounted on a developing device mounting part 5. A waste toner storage unit may be provided on one side of the developing device 30 to store waste toner generated from the developing device 30. The toner used in the developing device 30 may be moved to the waste toner storage unit and stored in the waste toner storage unit. In the embodiment of the present invention, the waste toner storage unit may be referred to as a cover unit 170.

A pressing assembly 100 may be provided on one side of the developing device 30 to adhere a developing unit 30*a* and a photosensitive unit 30*b* to each other. In detail, by an operation of the pressing assembly 100, the developing roller 34 of the developing unit 30*a* and the photoreceptor 32 of the photosensitive unit 30*b* are provided to be adhered to or separated from each other.

A guide rib 174 may be provided on the cover unit 170 to guide the operation of the pressing assembly 100.

Hereinafter, the relationship and configuration of the pressing assembly 100 and the guide rib 174 will be described in detail.

FIGS. 4A and 4B are views illustrating an operation of the pressing assembly and the developing unit according to the first embodiment of the present invention, FIGS. 5A, 5B, and 5C are views illustrating the operation of the pressing assembly according to the first embodiment of the present invention, FIGS. 6A and 6B are perspective views illustrating the pressing assembly according to the first embodiment of the present invention, and FIGS. 7A, 7B, and 7C are cross-sectional views of a pressing unit based on the operation of the pressing assembly according to the first embodiment of the present invention.

The pressing assembly 100 is disposed adjacent to the developing device 30, and provided so that the developing unit 30*a* and the photosensitive unit 30*b* are in contact with or separated from each other. In detail, the pressing assembly 100 is provided so that the developing roller 34 of the developing unit 30*a* and the photoreceptor 32 of the photosensitive unit 30*b* are in contact with or separated from each other. The position of the pressing assembly 100 is not limited, and in the embodiment of the present invention, the pressing assembly 100 is provided to be disposed on the developing device mounting part 5.

The pressing assembly 100 includes a rotating shaft 110, a pressing unit 120, and an operating unit 150.

The rotating shaft 110 is rotatably provided to transfer an operation of the operating unit 150 to the pressing unit 120. When a longitudinal direction of each of the developing device 30, the developing unit 30*a*, and the photosensitive unit 30*b* refers to as a first direction W1, the rotating shaft 110 may be formed in a long shape in the first direction W1. The first direction W1 may also be defined as a direction perpendicular to a proceeding direction of the printing medium. The rotating shaft 110 may be a center of the rotation of the operating unit 150.

The rotating shaft 110 may be disposed in the first direction W1, and provided to restrict movement in the first direction W1. The rotating shaft 110 may be provided to be capable of rotating about a rotation axis. At least one shaft stopper 111 may be provided on an outer circumferential surface of the rotating shaft 110 to restrict movement of the rotating shaft 110 in the first direction W1.

The pressing unit 120 is provided to adhere the developing roller 34 and the photoreceptor 32 to each other. In detail, the pressing unit 120 presses the developing unit 30*a* so that the developing roller 34 and the photoreceptor 32 are in contact with or adhere to each other. The pressing unit 120 may be disposed on the rotating shaft 110, and operated by receiving an operation of the operating unit 150 through the rotating shaft 110.

The pressing unit 120 is provided to operate in linkage with the operating unit 150. At least one pressing unit 120 may be provided. By this configuration, the at least one pressing unit 120 is provided to operate in linkage with the operating unit 150. When the pressing unit 120 is provided in a plural number, the plurality of pressing units 120 may be disposed on the rotating shaft 110 to be spaced apart from each other. For example, since the plurality of pressing units 120 on the rotating shaft 110 are spaced apart from each other by a certain interval and are configured to apply the same amount of a pressing force in the first direction W1, the developing unit 30*a* may be pressed with a uniform pressing force regardless of a position in a longitudinal direction.

The pressing unit 120 is provided to move between a pressing position P1 at which the developing roller 34 is in contact with the photoreceptor 32, and a release position P2 at which the developing roller 34 is separated from the photoreceptor 32 by moving back from the pressing position P1. In detail, when the pressing unit 120 is positioned at the pressing position P1, the developing unit 30*a* is pressed by the pressing unit 120, and thus the developing roller 34 is in contact with the photoreceptor 32. Further, when the pressing unit 120 is positioned at the release position P2, pressure on the developing unit 30*a* of the pressing unit 120 is released, and thus the developing roller 34 is separated from the photoreceptor 32.

The operating unit 150 is rotatably provided, and provided such that the pressing unit 120 operates by an operation of the operating unit 150. That is, the at least one pressing unit 120 operates in linkage with the operating unit 150.

The operating unit 150 may include an operating body 152 connected to the rotating shaft 110 and provided to be capable of rotating about the rotating shaft 110.

The operating unit 150 may move between an operating position O1 at which a pressing force of the pressing unit 120 is generated, and a standby position O2 at which the pressing force is released.

When the operating unit 150 is positioned at the operating position O1, the pressing unit 120 is in a state in which the developing unit 30*a* is pressed, and when the operating unit 150 is positioned at the standby position O2, the pressing unit 120 is in a state in which pressure on the developing unit 30*a* is released.

The operating position O1 of the operating unit 150 may include a fixed operating position O1*a* and a floating operating position O1*b*.

The fixed operating position O1*a* is provided to continuously position the pressing unit 120 at the pressing position P1, and the floating operating position O1*b* is provided to movably position the pressing unit 120 at the pressing position P1. When the operating unit 150 is positioned at the fixed operating position O1*a*, the operating unit 150 may be moved to the floating operating position O1*b* or the standby position O2 when an external force is applied, but when the operating unit 150 is positioned at the floating operating position O1*b*, the operating unit may move to the standby position O2 even when no external force is applied.

In a case in which the operating unit 150 is positioned at the fixed operating position O1*a* and a case in which the operating unit 150 is positioned at the floating operating position O1*b*, pressing forces generated on the pressing unit 120 linked with the operating unit 150 may be the same.

The pressing unit 120 may include a link unit 130 and a pressing part 140.

The link unit 130 converts a rotational motion of the rotating shaft 110 generated by an operation of the operating unit 150 into a linear motion.

The link unit 130 may include a first link member 131 and a second link member 132.

One end of the first link member 131 is restricted by the rotating shaft 110, and provided to rotate together with rotation of the rotating shaft 110. By this configuration, a center of rotation of the first link member 131 is provided to match a center of rotation of the rotating shaft 110.

At least part of the link unit 130 is disposed on an inner side of the developing device mounting part 5, and may be provided to restrict a predetermined range of the rotation of the first link member 131 by an inner wall of the developing device mounting part 5. This will be described below in detail.

The second link member 132 is provided with one end thereof connected to an end portion of the first link member 131 and the other end performing a linear reciprocating motion.

The pressing part 140 is provided on the other end of the second link member 132, and reciprocates through the linear reciprocating motion at the other end of the second link member 132.

The rotation of the operating unit 150 is transferred to rotation of the first link member 131, and the rotation of the first link member 131 is converted to a linear reciprocating motion at the other end of the second link member 132. By the operation at the other end of the second link member 132, the pressing part 140 linearly reciprocates and the developing unit 30*a* is pressed, and thus the developing roller 34 may be in contact with the photoreceptor 32.

The link unit 130 may include a pressing elastic member 134.

The pressing elastic member 134 provides an elastic force according to an operation of the pressing unit 120. That is, the pressing elastic member 134 is tensioned or compressed according to the operation of the pressing unit 120, and an elastic force is provided to the pressing unit 120.

The pressing elastic member 134 is disposed to have a direction component opposite a rotation direction of the rotating shaft 110. That is, when the first link member 131 is rotated by rotation of the rotating shaft 110, the pressing elastic member 134 is provided to apply an elastic force in a direction opposite a tangent direction with respect to a trace which is movement of one end of the first link member 131.

The pressing part 140 includes a pressing body 142 and a pressing moving rail 146.

A pressing surface 142*a* is provided in the front of the pressing body 142, and the pressing surface 142*a* is in direct contact with the developing unit 30*a* to press the developing unit 30*a*.

The pressing body 142 is provided on an end portion of the second link member 132 to operate in linkage with an operation of the second link member 132.

In detail, a hook pin 133 disposed perpendicular to a longitudinal direction of the second link member 132 is provided on an end portion of the second link member 132. A hook moving part 143 is formed on the pressing body 142 to allow movement of the hook pin 133.

The pressing part 140 may include a hook rib 144 provided to restrict an operation of the hook pin 133 on the hook moving part 143. The hook rib 144 may be provided on the pressing body 142. The hook rib 144 is provided to hook the hook pin 133 when the pressing unit 120 moves backward to the standby position O2 from the pressing position P1. By this configuration, when the pressing unit 120 moves from the standby position O2 to the pressing position P1, the second link member 132 is not related to the pressing part 140, but when the pressing unit 120 moves from the pressing position P1 to the standby position O2, the hook pin 133 of the second link member 132 is hooked by the hook rib 144, and thus the pressing part 140 moves backward.

The second link member 132 may include a hook inserting part 132*a* and a flexible mounting part 132*b*.

The hook inserting part 132*a* included in the second link member 132 is a part inserted into the hook moving part 143 of the pressing part 140 by the operation of the pressing unit 120.

The flexible mounting part 132*b* included in the second link member 132 is provided for mounting of the pressing elastic member 134. The flexible mounting part 132*b* is a remaining part of the second link member 132 excluding the hook inserting part 132*a*. That is, the flexible mounting part 132*b* may be a part formed between one surface of the hook rib 144 and an end portion of the second link member 132 in the second link member 132.

A length of the second link member 132 may be formed to be the same as the sum of lengths of the flexible mounting part 132*b* and the hook inserting part 132*a*. The lengths of the flexible mounting part 132*b* and the hook inserting part 132*a* may change according to an operation of the pressing unit 120 but the sum of the lengths thereof may be the same as the length of the second link member 132.

Since the length of the flexible mounting part 132*b* changes according to the operation of the pressing unit 120, the length of the pressing elastic member 134 provided on the flexible mounting part 132*b* also changes. Since the length of the flexible mounting part 132*b* changes according to the operation of the pressing unit 120, the length of the pressing elastic member 134 also changes according to the operation of the pressing unit 120. The change in the length of the pressing elastic member 134 denotes a change in an elastic force, and thus an elastic force of the pressing elastic member 134 changes according to the operation of the pressing unit 120.

By this configuration, when the pressing unit 120 moves from the standby position O2 to the pressing position P1, the length of the flexible mounting part 132*b* is decreased, and thus the elastic force of the pressing elastic member 134 provided on the flexible mounting part 132*b* is applied to one surface of the hook rib 144 of the pressing body 142, and the pressing part 140 moves in a direction in which the developing unit 30*a* is pressed. Meanwhile, when the pressing unit 120 moves from the pressing position P1 to the standby position O2, the length of the flexible mounting part 132*b* is increased, and thus the elastic force of the pressing elastic member 134 provided on the flexible mounting part 132*b* is reduced, the hook pin 133 of the second link member 132 is hooked by the hook rib 144, and thereby the pressing part 140 moves backward in a direction opposite a direction in which the developing unit 30*a* is pressed.

The pressing moving rail 146 is provided on the pressing body 142, and provided so that the pressing part 140 linearly reciprocates. In detail, a moving protrusion 147 corresponding to the pressing moving rail 146 is provided on the developing device mounting part 5, and the pressing moving rail 146 is provided to move with the moving protrusion 147.

The pressing moving rail 146 is provided on both side surfaces of the pressing body 142, and the pressing moving rails 146 may be vertically provided in a pair between which the moving protrusion 147 is inserted. A protrusion inserting part 146*a* may be formed such that the moving protrusion 147 can be inserted between the pair of pressing moving rails 146.

Rotational motions of the operating unit 150 and the rotating shaft 110 are transferred to the pressing part 140 by the first link member 131 and the second link member 132, and the rotational motions are converted to a linear reciprocating motion by the pressing moving rail 146 and the moving protrusion 147 in the pressing part 140.

The pressing elastic member 134 may be provided such that a compressed length thereof varies according to a state of the operating unit 150. As described above, since the length of the flexible mounting part 132*b* also changes according to an operation of the pressing unit 120, the length of the pressing elastic member 134 provided on the flexible mounting part 132*b* can be different.

In detail, a length of the pressing elastic member 134 may be referred to as a first length L1 when the operating unit 150 is positioned at the standby position O2, a length of the pressing elastic member 134 may be referred to as a second length L2 when the operating unit 150 is positioned at the fixed operating position O1*a*, and a length of the pressing elastic member 134 may be referred to as a third length L3 when the operating unit 150 is positioned at the floating operating position O1*b*.

When the pressing elastic member 134 has the first length L1, the pressing elastic member 134 may be in a state in which there is no tension or compression. When the pressing elastic member 134 has the second length L2 or the third length L3, the length is a compressed length when an elastic force is applied to the pressing elastic member 134. That is, the second length L2 and the third length L3 are smaller than the first length L1.

The second length L2 and the third length L3 may be the same to generate the same pressing force when the operating unit 150 is positioned at the fixed operating position O1*a* and positioned at the floating operating position O1*b*.

When the operating unit 150 is positioned between the fixed operating position O1*a* and the floating operating position O1*b*, compression of the pressing elastic member 134 may be maximized. That is, when the operating unit 150 moves between the fixed operating position O1*a* and the floating operating position O1*b*, the pressing elastic member 134 is compressed to a maximum compression length ML.

Accordingly, an external force, which changes the length of the pressing elastic member 134 from the second length L2 to maximum compression length ML, has to be applied to move the operating unit 150 from the fixed operating position O1*a* to the floating operating position O1*b* or the standby position O2. Further, an external force which changes the length of the pressing elastic member 134 to the maximum compression length ML is not required to move the operating unit 150 from the floating operating position O1*b* to the standby position O2, and the operating unit 150 is moved from the third length L3 to the first length L1 by elastic restoring.

An operation restricting surface 6*a* is provided above the link unit 130 to restrict an operation of the link unit 130. The operation restricting surface 6*a* is provided on the developing device mounting part 5, and provided to face an upper portion of the link unit 130. In detail, the developing device mounting part 5 may include an assembly cover 6 to cover at least part of the pressing assembly 100. The rotating shaft 110 and at least part of the pressing unit 120 may be disposed inside the assembly cover 6. The operation restricting surface 6*a* facing the link unit 130 is provided on an inner side of the assembly cover 6, and an operation of the link unit 130 is partially restricted by the operation restricting surface 6*a*.

This, along with the operating unit 150, will be described.

When the operating unit 150 is positioned at the fixed operating position O1*a*, an end portion of the first link member 131 of the link unit 130 is in a state in which rotation of one direction is restricted by the operation restricting surface 6*a*. At this time, since a compressed elastic force of the pressing elastic member 134 provided on the second link member 132 is applied in the other direction, the operating unit 150 may be fixed at the fixed operating position O1*a*.

FIG. 8A is a view illustrating the cover unit according to the first embodiment of the present invention, and FIG. 8B is an enlarged view of a portion A shown in FIG. 8A.

The cover unit 170 may be detachably provided on one side of the developing device 30. An operation of the operating unit 150 may be linked by detachment and attachment of the cover unit 170. In detail, while the cover unit 170 is mounted on the one side of the developing device 30, the operating unit 150 at the standby position O2 or fixed operating position O1*a* may be guided to the floating operating position O1*b*.

The cover unit 170 may include a cover body 172 and a guide rib 174.

The cover body 172 is provided to cover one side of the developing device 30, and connected to the developing device 30 so that waste toner generated from the developing device 30 may be stored.

The guide rib 174 is provided on one surface of the cover body 172 in a direction of the developing device 30 to guide rotation of the operating unit 150.

The guide rib 174 may include a first guide rib 175 and a second guide rib 176. The first guide rib 175 guides the operating unit 150 to move from the fixed operating position O1*a* to the floating operating position O1*b*, and the second guide rib 176 guides the operating unit 150 to move from the standby position O2 to the floating operating position O1*b*.

The cover unit 170 may include an operating unit mounting part 178. The operating unit mounting part 178 is provided on an end portion of the guide rib 174 to position the operating unit 150 at the floating operating position O1*b* when the cover unit 170 is mounted on the one side of the developing device 30. In the embodiment of the present invention, the operating unit mounting part 178 is provided between the first guide rib 175 and the second guide rib 176, and guides the operating unit 150 to be positioned from the fixed operating position O1*a* or standby position O2 to the floating operating position O1*b* corresponding to the operating unit mounting part 178 under a guidance of the guide rib 174.

The guide rib 174 may be formed with an end portion thereof sloped toward the operating unit mounting part 178. By this configuration, when the cover unit 170 is coupled with the one side of the developing device 30, the operating unit 150 is rotated, and thus the operating unit 150 may be mounted on the operating unit mounting part 178 corresponding to the floating operating position O1*b*.

In detail, the guide rib 174 may include a first rib contact part 174*a* and a second rib contact part 174*b* which is spaced apart from the first rib contact part 174*a* at a predetermined angle based on a center of rotation of the operating unit 150 and is formed to extend from first rib contact part 174*a* to form a slope inclined toward the cover body 172.

The operating unit 150 may include an operating body 152, and a first guide surface 152*a* and a second guide surface 152*b* provided on the operating body 152.

The first guide surface 152*a* is guided by the first guide rib 175, and may be provided on an upper portion of the operating body 152. In detail, the first guide surface 152*a* is provided on an upper corner of the operating body 152 to be guided from the first rib contact part 174*a* to the second rib contact part 174*b* of the first guide rib 175.

The second guide surface 152*b* is guided by the second guide rib 176, and may be provided on a lower portion of the operating body 152. In detail, the second guide surface 152*b* is provided on a lower corner of the operating body 152 to be guided from the first rib contact part 174*a* to the second rib contact part 174*b* of the second guide rib 176.

Hereinafter, an operation of the image forming apparatus according to the first embodiment of the present invention will be described.

After the developing device 30 is mounted on the developing device mounting part 5, the developing unit 30*a* and the photosensitive unit 30*b* have to be adhered to each other so that the developing roller 34 is in contact with the photoreceptor 32 to perform a printing operation.

The pressing assembly 100 is operated to adhere the developing unit 30*a* and the photosensitive unit 30*b* to each other.

The operating unit 150 is positioned at the standby position O2 in an initial state, and the operating unit 150 is rotated to press the developing unit 30*a* by the pressing unit 120 when the developing device 30 is mounted on the developing device mounting part 5.

When the operating unit 150 is rotated from the standby position O2 to the fixed operating position O1*a* or floating operating position O1*b*, the link unit 130 of the pressing unit 120 is operated to press the developing unit 30*a* by the pressing part 140. The developing unit 30*a* that is pressed as described above adheres to the photosensitive unit 30*b*, and the developing roller 34 is in contact with the photoreceptor 32.

As described above, the operating unit 150 may be arbitrarily moved from the standby position O2 to the fixed operating position O1*a* or the floating operating position O1*b* to adhere the developing unit 30*a* and the photosensitive unit 30*b* to each other, and the operating unit 150 may be moved to the operating position O1 by mounting the cover unit 170 on the one side of the developing device 30.

When the cover unit 170 is mounted on the one side of the developing device 30 regardless of a position of the operating unit 150, the operating unit 150 is moved to the floating operating position O1*b* by the guide rib 174.

In detail, when the operating unit 150 is positioned at the fixed operating position O1*a*, the operating unit 150 is moved to the floating operating position O1*b* under the guidance of the first guide rib 175 of the cover unit 170 when the cover unit 170 is mounted on the one side of the developing device 30. Further, when the operating unit 150 is positioned at the standby position O2, the operating unit 150 is moved to the floating operating position O1*b* under the guidance of the second guide rib 176 of the cover unit 170 when the cover unit 170 is mounted on the one side of the developing device 30. The operating unit 150 guided by the first guide rib 175 or second guide rib 176 is mounted on the operating unit mounting part 178, and is maintained at the floating operating position O1*b*.

When the operating unit 150 is positioned at the floating operating position O1*b*, the operating unit 150 is mounted on the operating unit mounting part 178 and is also maintained at the floating operating position O1*b* when the cover unit 170 is mounted on the one side of the developing device 30.

When the cover unit 170 is separated from the developing device 30 to replace the developing device 30, the operating unit 150 positioned at the floating operating position O1*b* is rotated to the standby position O2 by an elastic restoring force of the pressing elastic member 134. As the operating unit 150 is rotated to the standby position O2, a pressing force with respect to the developing unit 30*a* of the pressing unit 120 is released and the developing roller 34 is separated from the photoreceptor 32.

Hereinafter, an image forming apparatus according to the second embodiment of the present invention will be described.

The configurations duplicated with the previous embodiment will be omitted.

FIG. 9 is a cross-sectional view of an image forming apparatus according to a second embodiment of the present invention.

As shown in FIG. 9, an image forming apparatus 1001 includes a main body 1010, a printing medium supplying unit 1020, a light scanning unit 1030, a developing device 1040, a transfer unit 1060, a fixing unit 1070, and a printing medium ejecting unit 1080.

The main body 1010 forms an exterior of the image forming apparatus 1001 and supports various components installed therein. Further, a cover 1011 is rotatably installed on one side of the main body 1010. The cover 1011 opens and closes a part of the main body 1010. A user may open the cover 1011 to approach an inside of the main body 1010 and remove a paper sheet jammed in a printing path.

The printing medium supplying unit 1020 includes a cassette 1021 which stores a printing medium S, a pick-up roller 1022 which picks up the printing medium S stored in the cassette 1021 one sheet at a time, and a feeding roller 1023 which delivers the picked-up printing medium to the transfer unit 1060.

The light scanning unit 1030 is disposed under the developing unit 1041, and configured to form an electrostatic latent image on a surface of a photoreceptor 1052 by applying light corresponding to image information onto the photoreceptor 1052. The light scanning unit 1030 includes a light source 1032 which generates light, a plurality of reflective mirrors 1034 which change a path of the light generated from the light source 1032, and a plurality of windows 1036 which transmit light reflected by the plurality of reflective mirrors 1034.

The developing device 1040 includes a developing unit 1041 and a photosensitive unit 1050.

Developing units 1041Y, 1041M, 1041C, and 1041K, which respectively accommodate yellow (Y), magenta (M), cyan (C), and black (K) developers, each have a developing roller 1042 and supplying rollers 1044 and 1046. The supplying rollers 1044 and 1046 supply the developer to the developing roller 1042, and the developing roller 1042 attaches the developer onto a surface of the photoreceptor 1052, on which the electrostatic latent image is formed, to form a visible image.

Photosensitive units 1050Y, 1050M, 1050C, and 1050K respectively corresponding to the developing units 1041Y, 1041M, 1041C, and 1041K each have a photoreceptor 1052 and a charger 1054. The charger 1054 charges the photoreceptor 1052 to a predetermined potential level, and the electrostatic latent image is formed on the surface of the photoreceptor 1052 charged by the charger 1054.

The transfer unit 1060 includes a transfer belt 1061 which is in contact with a photoreceptor 1052 of each of the photosensitive units 1050Y, 1050M, 1050C, and 1050K and moves forward, a driving roller 1063 which drives the transfer belt 1061, a tension roller 1065 which applies predetermined tension to the transfer belt 1061, four rollers 1067 for transferring the visible image, which is developed on the photoreceptor 1052 of each of the photosensitive units 1050Y, 1050M, 1050C, and 1050K, onto the printing medium P.

The fixing unit 1070 includes a heating roller 1071 having a heat source and a pressing roller 1072 installed to face the heating roller 1071. When the printing medium passes between the heating roller 1071 and the pressing roller 1072, an image is fixed onto the printing medium by heat transmitted from the heating roller 1071 and pressure acting between the heating roller 1071 and the pressing roller 1072.

The printing medium ejecting unit 1080 includes a plurality of paper ejecting rollers 1081 to eject the printing medium passed through the fixing unit 1070 to the outside of the main body 1010.

Each of the photosensitive units 1050Y, 1050M, 1050C, and 1050K is fixed inside the main body 1010, and each of the developing units 1041Y, 1041M, 1041C, and 1041K is provided to be attachable and detachable through one side of the main body 1010. When the developing units 1041Y, 1041M, 1041C, and 1041K are mounted in the main body 1010, they are rotatably coupled based on rotation centers CY, CM, CC, and CK of the photosensitive units 1050Y, 1050M, 1050C, and 1050K, respectively. The developing roller 1042 included in each of the developing units 1041Y, 1041M, 1041C, and 1041K and the photoreceptor 1052 included in each of the photosensitive units 1050Y, 1050M, 1050C, and 1050K are in contact with each other when the image forming apparatus 1001 performs a printing operation, and are separated from each other when each of the developing units 1041Y, 1041M, 1041C, and 1041K is detached to perform replacement. Hereinafter, the configurations for attaching or detaching the developing roller 1042 to or from the photoreceptor 1052 will be described in detail.

FIG. 10 is a view illustrating an arrangement of a developing device and a light scanning unit of the image forming apparatus according to the second embodiment of the present invention.

The developing device 1040 may be mounted on a developing device mounting part 1005. The waste toner storage unit (not shown), in which waste toner generated from the developing device 1040 is stored, may be provided on one side of the developing device 1040. The waste toner used in the developing device 1040 may be moved to the waste toner storage unit and stored in the waste toner storage unit. In the embodiment of the present invention, the waste toner storage unit may be referred to as a cover unit 270. Similar to the previous embodiment, the cover unit 270 may be provided to guide an operation of the operating unit 250, but this configuration will not be described in the embodiment of the present invention.

A pressing assembly 200 may be provided on one side of the developing device 1040 to adhere the developing unit 1041 and the photosensitive unit 1050 to each other. In detail, through an operation of the pressing assembly 200, the developing roller 1042 of the developing unit 1041 and the photoreceptor 1052 of the photosensitive unit 1050 adhere to or are separated from each other.

FIGS. 11A and 11B are views illustrating an operation of the pressing assembly and the developing device according to the second embodiment of the present invention, FIGS. 12A and 12B are perspective views illustrating the operation of the pressing assembly according to the second embodiment of the present invention, FIGS. 13A and 13B are cross-sectional views of a pressing unit based on the operation of the pressing assembly according to the second embodiment of the present invention, and FIGS. 14A and 14B are cross-sectional views illustrating a shutter unit and the developing device based on the operation of the pressing assembly according to the second embodiment of the present invention.

The pressing assembly 200 is disposed adjacent to the developing device 1040, and provided so that the developing unit 1041 is in contact with or separated from the photosensitive unit 1050. In detail, the pressing assembly 200 is provided so that the developing roller 1042 of the developing unit 1041 is in contact with or separated from the photoreceptor 1052 of the photosensitive unit 1050. A position of the pressing assembly 200 is not limited, and in the embodiment of the present invention, the pressing assembly 200 is disposed on the developing device mounting part 1005.

The pressing assembly 200 includes a rotating shaft 210, a pressing unit 220, and an operating unit 250.

The rotating shaft 210 is rotatably provided to transfer the operation of the operating unit 250 to the pressing unit 220. At least one shaft stopper 211 may be provided on an outer circumferential surface of the rotating shaft 210 to restrict movement of the rotating shaft 210 in the first direction W1.

The pressing unit 220 is provided to adhere the developing roller 1042 and the photoreceptor 1052 to each other. The pressing unit 220 operates in linkage with the operating unit 250. The pressing unit 220 is provided to move between the pressing position P1 at which the developing roller 1042 is in contact with the photoreceptor 1052, and a release position P2 at which the developing roller 1042 is separated from the photoreceptor 1052 by moving back from the pressing position P1.

The operating unit 250 is rotatably provided such that the pressing unit 220 operates through an operation of the operating unit 250. That is, at least one pressing unit 220 operates in linkage with the operating unit 250.

The operating unit 250 includes an operating body 252 connected to the rotating shaft 210 and provided to be capable of rotating about the rotating shaft 210.

The operating unit 250 is provided to move between the operating position O1 at which a pressing force of the pressing unit 220 is generated, and the standby position O2 at which the pressing force is released.

The pressing unit 220 may include a link unit 230 and a pressing part 240.

The link unit 230 may include a first link member 231, a second link member 232, and a pressing elastic member 234. The second link member 232 may include a hook inserting part 232*a* and a flexible mounting part 232*b*. A hook pin 233 disposed perpendicular to a longitudinal direction of the second link member 232 is provided on an end portion of the second link member 232.

When the pressing unit 220 is positioned between the operating position O1 and the standby position O2, compression of the pressing elastic member 234 may be maximized. That is, when the operating unit 250 moves between the operating position O1 and the standby position O2, the pressing elastic member 234 is compressed to a maximum compression length ML.

The operation restricting surface 6*a* is provided on an upper portion of the link unit 230 to restrict an operation of the link unit 230. The operation restricting surface 6*a* is provided on the assembly cover 6 of the developing device mounting part 1005, and faces the upper portion of the link unit 230.

The pressing part 240 includes a pressing body 242 and a pressing moving rail 246. A pressing surface 242*a* is provided in the front of the pressing body 242, and the pressing surface 242*a* is in direct contact with the developing unit 1041 to press the developing unit 1041. A hook moving part 243 is formed on the pressing body 242 to move the hook pin 233. The pressing part 240 may include a hook rib 244 provided to restrict an operation of the hook pin 233 on the hook moving part 243. The hook rib 244 may be provided on the pressing body 242.

The pressing moving rail 246 is provided on the pressing body 242, and provided so that the pressing part 240 linearly reciprocates. In detail, a moving protrusion 247 corresponding to the pressing moving rail 246 is provided on the developing device mounting part 1005, and the pressing moving rail 246 is provided to move with the moving protrusion 247.

The pressing moving rail 246 is provided on both side surfaces of the pressing body 242, and the pressing moving rail 246 may be vertically provided in a pair between which the moving protrusion 247 is inserted. A protrusion inserting part 246*a* may be formed such that the moving protrusion 247 can be inserted between the pair of pressing moving rails 246.

The pressing part 240 may include a shutter guide member 248.

The shutter guide member 248 guides an operation of a shutter unit 280 to open and close a window 1036. In the embodiment of the present invention, since a pair of pressing units 220 are provided, the shutter unit 280 is operated by guiding both sides of the shutter unit 280. However, the present invention is not limited thereto, and it is sufficient when at least one pressing unit 220 is provided to guide the operation of the shutter unit 280.

The shutter guide member 248 is provided to protrude from one side surface of the pressing body 242 of the pressing part 240. That is, the shutter guide member 248 is provided in a protrusion shape protruding from the pressing body 242.

In detail, the shutter guide member 248 is formed to protrude from the pressing body 242, and formed to protrude perpendicular to a direction of back and forth movement of the pressing part 240. By this configuration, the shutter unit 280 may be guided together with a back and forth operation of the pressing part 240.

The shutter unit 280 is provided to open and close the window 1036. Light generated from a light scanning unit is transmitted through the window 1036, the transmitted light passes through the window 1036 and is applied to the photoreceptor 1052. As the shutter unit 280 opens and closes the window 1036, light is selectively applied to the photoreceptor 1052.

The shutter unit 280 includes a shutter body 282 and a shutter rotating part 284 provided on the shutter body 282.

The shutter body 282 corresponds to the window 1036. The shutter body 282 is formed in a long shape in a longitudinal direction of the window 1036 or in a longitudinal direction of the photoreceptor 1052, corresponding to the window 1036 and the photoreceptor 1052. The shutter body 282 is provided to move between an open position S1 at which the window 1036 is opened, and a closed position S2 at which the window 1036 is closed. The shutter body 282 is rotated about the shutter rotating part 284, and thus the shutter body 282 may move between the open position S1 and the closed position S2.

A shutter protrusion 283 corresponding to the shutter guide member 248 of the pressing part 240 is provided on the shutter body 282. The shutter protrusion 283 is formed to protrude from the shutter body 282, and provided on an end portion of the shutter body 282. In the embodiment of the present invention, since a pair of pressing units 220 are provided on both end portions of the shutter unit 280, a pair of shutter protrusions 283 are provided on both end portions of the shutter body 282.

By this configuration, while the pressing unit 220 moves from the release position P2 to the pressing position P1, the shutter guide member 248 of the pressing part 240 presses the shutter protrusion 283 of the shutter unit 280. Accordingly, when the pressing unit 220 is positioned at the pressing position P1, the developing unit 1041 is pressed and the shutter unit 280 is simultaneously positioned at the open position S1.

The shutter unit 280 is moved from the closed position S2 to the open position S1 by pressing the shutter protrusion 283 by the shutter guide member 248, and moved from the open position S1 to the closed position S2 by dropping by the weight of the shutter unit 280. Further, the movement of the shutter unit 280 from the open position S1 to the closed position S2 may be linked with movement of the pressing unit 220 from the pressing position P1 to the release position P2, but in the embodiment of the present invention, for example, the shutter unit 280 is operated by its own weight.

The shutter body 282 is rotated about the shutter rotating part 284, and the position of the shutter body 282 when the shutter unit 280 is positioned at the closed position S2 and the position of the shutter body 282 when the shutter unit 280 is positioned at the open position S1 form an acute angle. That is, a rotation angle between the open position S1 and the closed position S2 of the shutter unit 280 is an acute angle.

The shutter body 282 is parallel to the window 1036 at the closed position S2, and the shutter body 282 forms an acute angle with the window 1036 and is rotated at the open position S1.

By this configuration, when the shutter unit 280 moves from the open position S1 to the closed position S2, the shutter unit 280 is moved by the weight of the shutter body 282.

FIG. 15 is a perspective view illustrating a position of the operating unit according to the second embodiment of the present invention, FIG. 16 is a side view illustrating a pressed state of the operating unit according to the second embodiment of the present invention, FIG. 17 is an exploded perspective view of the operating unit in the pressing assembly according to the second embodiment of the present invention, and FIG. 18 is a cross-sectional perspective view illustrating the operating unit according to the second embodiment of the present invention.

The operating unit 250 is rotatably provided such that the pressing unit 220 operates through an operation of the operating unit 250. That is, at least one pressing unit 220 operates in linkage with the operating unit 250.

The operating unit 250 may include the operating body 252 connected to the rotating shaft 210, and provided to be capable of rotating about the rotating shaft 210.

The operating unit 250 may be provided to move between the operating position O1 at which a pressing force of the pressing unit 220 is generated, and the standby position O2 at which the pressing force is released.

When the operating unit 250 is positioned at the operating position O1, the pressing unit 220 is in a state in which the developing unit 1041 is pressed, and when the operating unit 250 is positioned at the standby position O2, the pressing unit 220 is in a state in which pressure on the developing unit 1041 is released.

The operating unit 250 may include the operating body 252 and a mounting pressing member 260.

The operating body 252 is provided to be capable of rotating about the rotating shaft 210.

The mounting pressing member 260 is provided on the operating body 252, and provided to press in a direction in which the developing device 1040 is mounted on the developing device mounting part 1005 when the operating unit 250 is positioned at the operating position O1. The first direction W1 includes a mounting direction W1*a* in which the developing device 1040 is mounted on the developing device mounting part 1005, and a detachment direction W1*b* in which the developing device 1040 is detached from the developing device mounting part 1005 as a direction opposite the mounting direction W1*a*. The mounting pressing member 260 presses the developing device 1040 in the mounting direction W1*a*. In detail, the mounting pressing member 260 may press the photosensitive unit 1050 of the developing device 1040.

The operating unit 250 may include an operation rotating part 254. The operation rotating part 254 is rotatably supported on the rotating shaft 210 in the operating body 252. A hollow part, through which the rotating shaft 210 passes, is formed inside the operation rotating part 254, and the operating body 252 is formed to extend from the operation rotating part 254 in a direction perpendicular to a rotation axis. One end of the operation rotating part 254 is supported on the developing device mounting part 1005.

An operation elastic part 264 is provided on the operation rotating part 254, and provided so that the operating unit 250 can press the developing device 1040 in the mounting direction W1*a*. The operation elastic part 264 will be described below in detail.

The mounting pressing member 260 may include a mounting pressing surface 262 in contact with the developing device 1040 in a direction of the developing device 1040. The mounting pressing surface 262 is in direct contact with the developing device 1040, and while the operating unit 250 moves from the standby position O2 to the operating position O1, the mounting pressing surface 262 presses the developing device 1040.

The mounting pressing surface 262 may include a first mounting pressing part 262*a* and a second mounting pressing part 262*b*. The first mounting pressing part 262*a* may be positioned ahead of the second mounting pressing part 262*b* with respect to a rotation direction of the operating unit 250 from the standby position O2 to the operating position O1.

While the operating unit 250 is positioned at the standby position O2 or moves from the standby position O2 to the operating position O1, the first mounting pressing part 262*a* in contact with the developing device 1040 is more concavely provided in the detachment direction W1*b* than the second mounting pressing part 262*b* in contact with the developing device 1040 after the operating unit 250 is moved to the operating position O1. Meanwhile, the second mounting pressing part 262*b* in contact with the developing device 1040 when the operating unit 250 is positioned at the operating position O1 protrudes in the mounting direction W1*a* more than the first mounting pressing part 262*a* in contact with the developing device 1040 when the operating unit 250 is positioned at the standby position O2.

When the operating unit 250 moves from the standby position O2 to the operating position O1, the first mounting pressing part 262*a* first comes in contact with the developing device 1040 and then the second mounting pressing part 262*b* comes in second contact with the developing device 1040. That is, since the second mounting pressing part 262*b* extending from the first mounting pressing part 262*a* is spaced apart from the first mounting pressing part 262*a* in the mounting direction W1*a*, the second mounting pressing part 262*b* is in contact with the developing device 1040 after the operating unit 250 is moved to the operating position O1.

At least part of the mounting pressing surface 262 is formed to have a curved surface. Accordingly, the second mounting pressing part 262*b* may be formed to extend from the first mounting pressing part 262*a* to the curved surface. By this configuration, when the operating unit 250 moves from the standby position O2 to the operating position O1, the developing device 1040 may be naturally pressed.

A mounting pressurized surface 1056 corresponding to the mounting pressing surface 262 is provided on the developing device 1040. The mounting pressurized surface 1056 is pressed by the mounting pressing surface 262 of the operating unit 250. In detail, the mounting pressurized surface 1056 may be provided on the photosensitive unit 1050 of the developing device 1040.

The mounting pressurized surface 1056 may be formed to have a slope corresponding to the mounting pressing surface 262. That is, the mounting pressurized surface 1056 may include a first mounting pressurized part 1056*a* in contact with the first mounting pressing part 262*a* and a second mounting pressurized part 1056*b* in contact with the second mounting pressing part 262*b* and extending from the first mounting pressurized part 1056*a* to form a slope inclined in the detachment direction W1*b*.

The operating unit 250 may include the operation elastic part 264.

The operation elastic part 264 is provided on the operation rotating part 254 to apply an elastic force to the operating unit 250. That is, for the operating unit 250 to press the developing device 1040 in the mounting direction W1*a*, the elastic force of the operating unit 250 is generated in the mounting direction W1*a*. The operation rotating part 254 may be provided in a cylindrical shape, and provided with an empty internal space. A mounting space 256, in which the operation elastic part 264 may be positioned, may be formed inside the operation rotating part 254. The mounting space 256 includes a first mounting space 256*a* on which a mounting elastic member 265 to be described below is mounted, and a second mounting space 256*b* on which a fixing member 266 to be described below is mounted.

The operation elastic part 264 includes the mounting elastic member 265 and the fixing member 266.

The fixing member 266 is provided on the rotating shaft 210 to support one end of the mounting elastic member 265. That is, movement of the rotating shaft 210 is restricted in the first direction W1, the fixing member 266 is disposed perpendicular to an axial direction of the rotating shaft 210, and thus the mounting elastic member 265 is not separated from the fixing member 266. A shape in which the fixing member 266 is provided on the rotating shaft 210 is not limited, and in the embodiment of the present invention, a pin shape is provided to pass perpendicular to an axial direction of the rotating shaft 210.

The operating unit 250 includes a moving limit surface 257 in contact with the fixing member 266 to restrict movement of the operating unit 250 in the detachment direction W1*b*. The second mounting space 256*b* may be formed inside the operation rotating part 254 to have a boundary with the moving limit surface 257. When the operating unit 250 moves in the detachment direction W1*b*, the fixing member 266 is in contact with the moving limit surface 257 of the operating unit 250, and thus movement of the operating unit 250 in the detachment direction W1*b* is restricted.

Since the fixing member 266 supports one end of the mounting elastic member 265, a radius of the second mounting space 256*b* in which the fixing member 266 is mounted is greater than that of the first mounting space 256*a* in which the mounting elastic member 265 is mounted, and the moving limit surface 257 may be formed from a circumference of the first mounting space 256*a* to a circumference of the second mounting space 256*b*.

The mounting elastic member 265 may be disposed in the mounting space 256. The mounting elastic member 265 is provided with one end thereof supporting the fixing member 266 and the other end supporting an inner side surface of the operation rotating part 254 in an axial direction. The mounting elastic member 265 is provided to surround an outer circumferential surface of the rotating shaft 210 to transmit an elastic force generated from the mounting elastic member 265 to the operating unit 250 in an axial direction. In detail, the mounting elastic member 265 generates the elastic force to press the operating unit 250 in the mounting direction W1*a*.

Hereinafter, an operation of the image forming apparatus according to the second embodiment of the present invention will be described.

After the developing device 1040 is mounted on the developing device mounting part 1005, in order to perform a printing operation, the developing unit 1041 and the photosensitive unit 1050 have to be adhered to each other so that the developing roller 1042 and the photoreceptor 1052 come in contact with each other.

The pressing assembly 200 is operated to adhere the developing unit 1041 and the photosensitive unit 1050 to each other.

The operating unit 250 is positioned at the standby position O2 in an initial state, and the operating unit 250 is rotated to press the developing unit 1041 by the pressing unit 220 when the developing device 1040 is mounted on the developing device mounting part 1005.

When the operating unit 250 is rotated from the standby position O2 to the operating position O1, the link unit 230 of the pressing unit 220 is operated and the pressing part 240 presses the developing unit 1041. The pressed developing unit 1041 described above is adhered to the photosensitive unit 1050, and the developing roller 1042 is in contact with the photoreceptor 1052.

While the operating unit 250 is rotated from the standby position O2 to the operating position O1, the pressing unit 220 is moved from the release position P2 to the pressing position P1. While the pressing unit 220 moves from the release position P2 to the pressing position P1, the pressing part 240 presses the developing unit 1041 and simultaneously opens the shutter unit 280.

In detail, the pressing surface 242*a* of the pressing part 240 presses the developing unit 1041 and the shutter guide member 248 of the pressing part 240 guides rotation of the shutter unit 280. The shutter guide member 248 presses the shutter protrusion 283 of the shutter unit 280, and the shutter unit 280 is rotated about the shutter rotating part 284 and is moved from the closed position S2 to the open position S1.

While the operating unit 250 is rotated from the standby position O2 to the operating position O1, the developing device 1040 is in a state in which an image may be formed, and light generated from the light scanning unit is simultaneously applied to the photoreceptor 1052.

When the operating unit 250 is positioned at the operating position O1, the pressing unit 220 presses the developing unit 1041 and the operating unit 250 presses the photosensitive unit 1050 of the developing device 1040 in the mounting direction W1*a*. The mounting pressing member 260 of the operating unit 250 presses the developing device 1040 in the mounting direction W1*a*.

When the operating unit 250 is rotated from the standby position O2 to the operating position O1, the first mounting pressing part 262*a* of the mounting pressing member 260 is in contact with the first mounting pressurized part 1056*a* within the mounting pressurized surface 1056 in the developing device 1040. When the operating unit 250 is rotated to the operating position O1, the second mounting pressing part 262*b* of the mounting pressing member 260 is in contact with the second mounting pressurized part 1056*b* within the mounting pressurized surface 1056 in the developing device 1040.

In the above process, the operating unit 250 presses the photosensitive unit 1050 of the developing device in the mounting direction W1*a* by generating an elastic force by the operation elastic part 264.

When the operating unit 250 is rotated from the pressing position P1 to the standby position O2, an operation of the operating unit 250 is the reverse of the above process.

Hereinafter, an image forming apparatus according to a third embodiment of the present invention will be described.

The configurations duplicated with the previous embodiment will be omitted.

FIG. 19 is a view illustrating an arrangement of a developing device and a cover unit of the image forming apparatus according to the third embodiment of the present invention, FIG. 20 is a front view of a pressing unit according to the third embodiment of the present invention, and FIG. 21 is a perspective view illustrating the pressing unit and a shutter unit according to the third embodiment of the present invention.

The developing device 1040 may be mounted on a developing device mounting part 1005. The waste toner storage unit (not shown), in which waste toner generated from the developing device 1040 is stored, may be provided on one side of the developing device 1040. The waste toner used in the developing device 1040 may be moved to the waste toner storage unit and stored in the waste toner storage unit. In the embodiment of the present invention, the waste toner storage unit may be referred to as a cover unit 370.

The shutter unit 380 is provided to open and close the window 1036. Light generated from a light scanning unit is projected through the window 1036, and the projected light passes through the window 1036 and is applied to the photoreceptor 1052. As the shutter unit 380 opens and closes the window 1036, light is selectively applied to the photoreceptor 1052.

The shutter unit 380 includes a shutter body 382 and a shutter pressurized part 386 provided on the shutter body 382.

The shutter body 382 corresponds to the window 1036. The shutter body 382 is formed in a long shape in a longitudinal direction of the window 1036 or in a longitudinal direction of the photoreceptor 1052, corresponding to the window 1036 and the photoreceptor 1052. The shutter body 382 is provided to move between an open position S1 at which the window 1036 is opened, and a closed position S2 at which the window 1036 is closed. In the embodiment of the present invention, since an image forming apparatus having a plurality of developing devices 1040 is implemented, the shutter body 382 also corresponds to the plurality of developing devices 1040. However, an image forming apparatus having a single developing device 1040 instead of the plurality of developing devices 1040 may also be implemented.

The shutter body 382 includes a shutter hole 382*a* corresponding to the window 1036. The shutter hole 382*a* is formed in a long shape corresponding to the window 1036, and light projected to the window 1036 may pass through the photoreceptor 1052.

When the shutter unit 380 is positioned at the open position S1, light projected to the window 1036 is provided to pass through the shutter hole 382*a*, and when the shutter unit 380 is positioned at the closed position S2, the light projected to the window 1036 is blocked by the shutter body 382.

The light projected to the window 1036 may be selectively transmitted to the photoreceptor 1052 through movement of the shutter unit 380 between the open position S1 and the closed position S2.

A longitudinal direction of the window 1036 or a longitudinal direction of the photosensitive unit 1050 is referred to as a first direction W1, and the shutter unit 380 reciprocates in a second direction W2 perpendicular to the first direction W1.

The shutter unit 380 includes an elastic restoring member 387. The elastic restoring member 387 is provided on one side of the shutter body 382 so that the shutter unit 380 returns from the open position S1 to the closed position S2. The elastic restoring member 387 is provided with one end thereof supporting the shutter body 382 and the other end supporting the developing device mounting part 1005. By this configuration, when pressure from the pressing unit 320 is released, the shutter unit 380 may be elastically returned from the open position S1 to the closed position S2. A position of the elastic restoring member 387 is not limited, but in the embodiment of the present invention, the elastic restoring member 387 is disposed on a moving path of the shutter unit 380. In detail, the elastic restoring member 387 is provided in the rear of a moving path of the shutter body 382 to elastically return the shutter body 382.

The pressing unit 320 operates in linkage with the shutter unit 380. The pressing unit 320 moves between the pressing position P1 at which the shutter unit 380 is pressed, and a release position P2 at which pressure on the shutter unit 380 is released.

The pressing unit 320 includes a pressing body 342 and a pressing elastic member 348 which provides an elastic force to the pressing body 342.

The pressing body 342 is reciprocated by an external force. The pressing body 342 may be formed in a long shape in the first direction W1, and one end thereof receives the external force in the first direction W1 and the other end transmits the external force to the shutter unit 380.

The pressing body 342 is formed in a long shape in the first direction W1 to reciprocate in the first direction W1. In detail, the pressing body 342 is moved in the mounting direction W1*a* of the first direction W1 by the external force, and is returned in the detachment direction W1*b* when the external force is released. That is, the pressing body 342 is moved from the release position P2 to the pressing position P1 by the external force, and is returned from the pressing position P1 to the release position P2 when the external force is released.

The pressing elastic member 348 is provided to return the pressing unit 320 moved in the mounting direction W1*a* to the detachment direction W1*b*. The pressing body 342 may include an elastic hook protrusion protruding from the pressing body 342 to support one end of the pressing elastic member 348. The pressing elastic member 348 is provided with one end thereof supporting the elastic hook protrusion protruding from the pressing body 342 and the other end supporting the main body. When an external force is applied to the pressing body 342 and it moves in the mounting direction W1*a*, the pressing elastic member 348 generates an elastic force of the pressing body 342 in the detachment direction W1*b*, and when the external force of the pressing body 342 is released, the pressing body 342 is returned to the original position by an elastic force of the pressing elastic member 348.

The other end of the pressing body 342 is provided to press the shutter unit 380. In detail, the pressing body 342 includes a pressing part 340 which presses the shutter unit 380. The pressing part 340 presses the shutter pressurized part 386 of the shutter unit 380. The pressing unit 320 reciprocates in the first direction W1 and the shutter unit 380 reciprocates in the second direction W2 perpendicular to the first direction W1, and thus the shutter pressurized part 386 of the shutter unit 380 has a slope inclined with respect to the first direction W1 and the second direction W2.

That is, the shutter pressurized part 386 includes a pressing slope 386*a* having a first direction W1 component and a second direction W2 component so that the shutter unit 380 operates in the second direction W2, which is a moving direction perpendicular to the first direction W1, with respect to the first direction W1 which is a moving direction of the pressing unit 320. The pressing part 340 of the pressing body 342 is in contact with the pressing slope 386*a* to press the pressing slope 348, and thus the shutter unit 380 may be moved in the second direction W2.

The cover unit 370 may be provided to be detachable on one side of the developing device 1040. Detachment of the cover unit 370 may be linked with an operation of the pressing unit 320. In detail, while the cover unit 370 is mounted on one side of the developing device 1040, the pressing unit 320 is moved from the release position P2 to the pressing position P1. Meanwhile, when the cover unit 370 is detached from the one side of the developing device 1040, the pressing unit 320 is moved from the pressing position P1 to the release position P2.

Hereinafter, an operation of the image forming apparatus according to the third embodiment of the present invention will be described.

FIGS. 22A and 22B are views illustrating a linking operation of the pressing unit, the shutter unit, and the cover unit according to the third embodiment of the present invention.

First, an operation for opening the shutter unit 380 will be described.

When the pressing unit 320 moves from the release position P2 to the pressing position P1, the pressing part 340 of the pressing unit 320 presses the shutter unit 380 to move the shutter unit 380 from the closed position S2 to the open position S1.

In detail, while the pressing unit 320 moves from the release position P2 to the pressing position P1, the pressing part 340 is moved in the first direction W1 to press the shutter pressurized part 386 of the shutter unit 380. The pressing slope 386*a* of the shutter pressurized part 386 converts the movement of the pressing part 340 in the first direction W1 to movement of the shutter unit 380 in the second direction W2.

While the shutter unit 380 moves from the closed position S2 to the open position S1, light transmitted to the window 1036 is transmitted to the photoreceptor 1052 to form an electrostatic latent image.

The pressing unit 320 may be directly moved from the release position P2 to the pressing position P1, and the pressing unit 320 may be operated by the cover unit 370 according to the embodiment of the present invention.

When the cover unit 370 is mounted on one side of the developing device 1040, the cover body 372 of the cover unit 370 presses the pressing unit 320 to move the pressing unit 320 from the release position P2 to the pressing position P1. By this configuration, the cover unit 370 is mounted on the developing device 1040, and thus the developing device 1040 can be used, and the window 1036 is simultaneously opened and light scanning is possible.

Next, an operation for closing the shutter unit 380 will be described.

When the pressing unit 320 moves from the pressing position P1 to the release position P2, the pressing part 340 of the pressing unit 320 releases pressure on the shutter unit 380. The elastic restoring member 387 of the shutter unit 380 returns the shutter unit 380 from the open position S1 to the closed position S2 when the pressure on the pressing unit 320 is released.

When the pressing unit 320 is directly moved from the release position P2 to the pressing position P1, the pressing unit 320 is moved from the pressing position P1 to the release position P2 by an elastic force of the pressing elastic member 348 when the pressure on the pressing unit 320 is released.

When the pressing unit 320 is pressed by the cover unit 370 and the cover unit 370 is separated from the developing device 1040 according to the embodiment of the present invention, restriction on the pressing unit 320 by the cover unit 370 is released, and the pressing unit 320 is moved from the pressing position P1 to the release position P2 by the elastic force of the pressing elastic member 348.

Hereinafter, an image forming apparatus according to the fourth embodiment of the present invention will be described.

Figure 23:
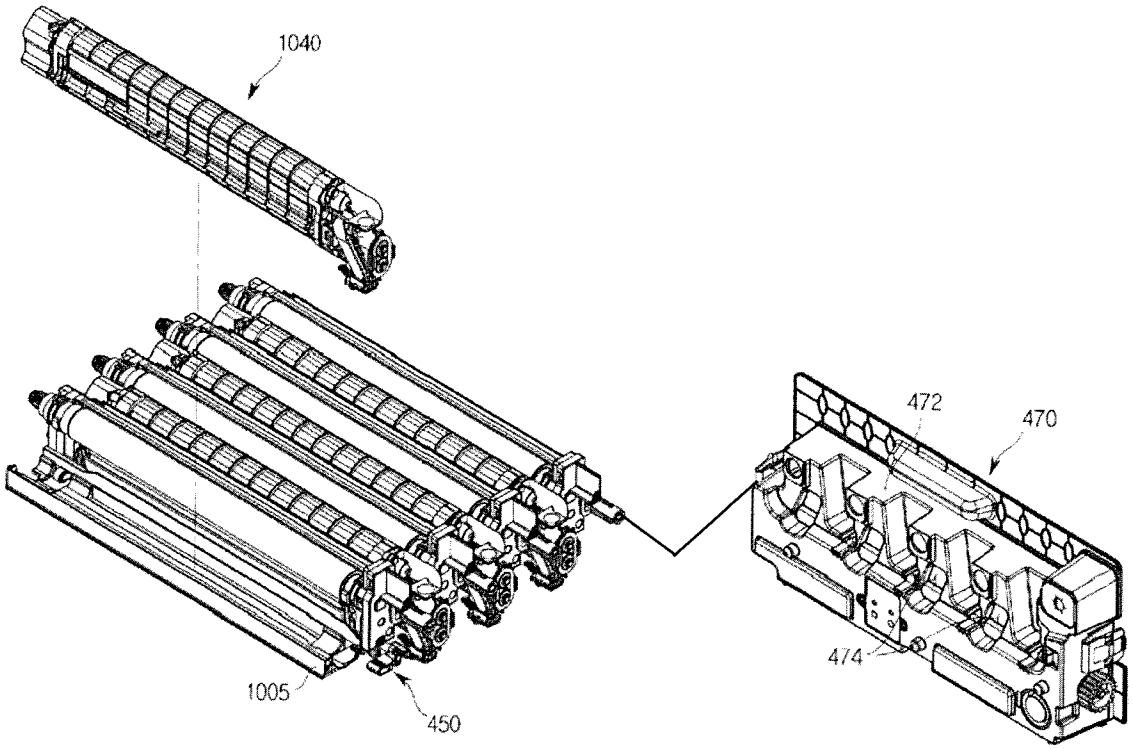
FIG. 23 is a view illustrating a developing device and a cover unit according to a fourth embodiment of the present invention.
Figure 25B:
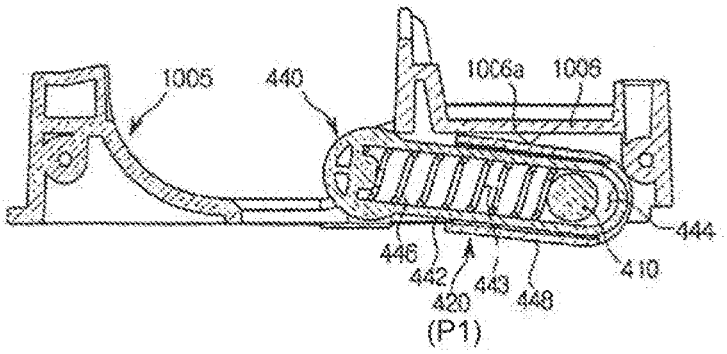
Figure 26:
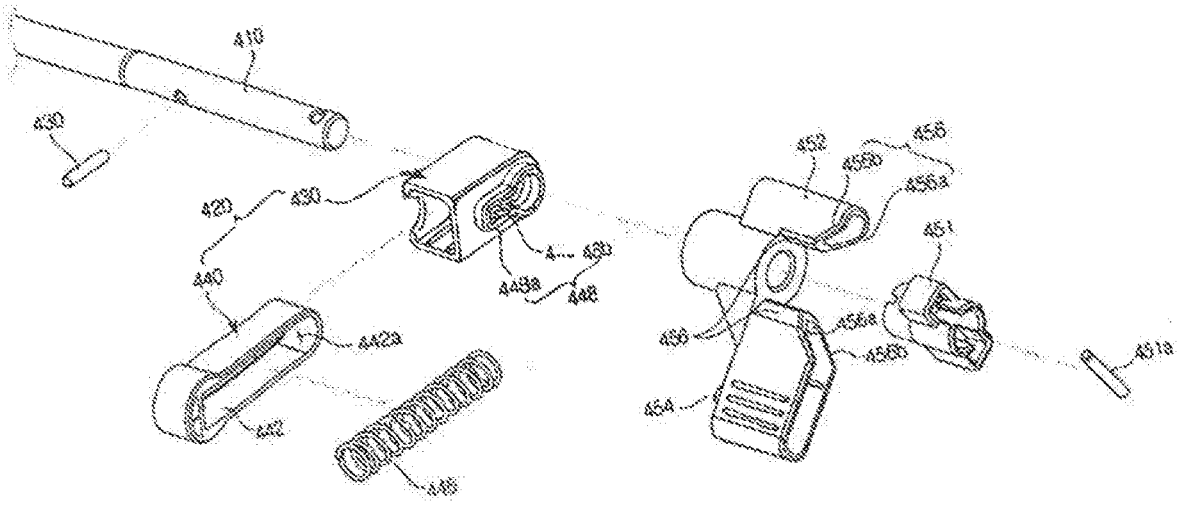
FIG. 26 is an exploded perspective view of the pressing assembly according to the fourth embodiment of the present invention.

FIG. 23 is a view illustrating a developing device and a cover unit according to the fourth embodiment of the present invention, FIGS. 24A and 24B are views illustrating an operation of a pressing assembly and the developing device according to the fourth embodiment of the present invention, FIGS. 25A and 25B are cross-sectional views of a pressing unit based on the operation of the pressing assembly according to the fourth embodiment of the present invention, and FIG. 26 is an exploded perspective view of the pressing assembly according to the fourth embodiment of the present invention.

The pressing assembly 400 is disposed adjacent to the developing device 1040 and provided so that the developing unit 1041 is in contact with or separated from the photosensitive unit 1050. In detail, the pressing assembly 100 is provided so that the developing roller 1042 of the developing unit 1041 is in contact with or separated from the photoreceptor 1052 of the photosensitive unit 1050. A position of the pressing assembly 100 is not limited, but in the embodiment of the present invention, the pressing assembly 100 is disposed on the developing device mounting part 1005.

The pressing assembly 400 includes a rotating shaft 410, a pressing unit 420, and an operating unit 450.

The rotating shaft 410 is rotatably provided to transfer an operation of the operating unit 450 to the pressing unit 420. When a longitudinal direction of each of the developing device 1040, the developing unit 1041, and the photosensitive unit 1050 is referred to as a first direction W1, the rotating shaft 410 may be formed in a long shape in the first direction W1. The first direction W1 may also be defined as a direction perpendicular to a direction in which the printing medium proceeds. The rotating shaft 410 may be a center of the rotation of the operating unit 450.

The rotating shaft 410 may be disposed in the first direction W1, and provided to restrict movement in the first direction W1. The rotating shaft 410 may be provided to allow rotation about a rotation axis. At least one shaft stopper 411 may be provided on an outer circumferential surface of the rotating shaft 410 to restrict movement of the rotating shaft 410 in the first direction W1.

The pressing unit 420 is provided to adhere the developing roller 1042 and the photoreceptor 1052 to each other. In detail, the pressing unit 420 presses the developing unit 1041 so that the developing roller 1042 and the photoreceptor 1052 are in contact with or adhere to each other. The pressing unit 420 may be disposed on the rotating shaft 410 and operated by receiving the operation of the operating unit 450 through the rotating shaft 410.

The pressing unit 420 is provided to operate in linkage with the operating unit 450. At least one pressing unit 420 may be provided. By this configuration, the at least one pressing unit 420 is provided to operate in linkage with the operating unit 450. When the pressing unit 420 is provided in plural numbers, the plurality of pressing units 420 may be disposed on the rotating shaft 410 to be spaced apart from each other. For example, as the plurality of pressing units 420 on the rotating shaft 410 are spaced a certain interval from each other and configured to apply the same amount of a pressing force in the first direction W1, the developing unit 1041 may be pressed by a uniform pressing force regardless of a position in a longitudinal direction.

The pressing unit 420 is provided to move between a pressing position P1 at which the developing roller 1042 is in contact with the photoreceptor 1052, and a release position P2 at which the developing roller 1042 is separated from the photoreceptor 1052 by moving back from the pressing position P1. In detail, when the pressing unit 420 is positioned at the pressing position P1, the developing unit 1041 is pressed by the pressing unit 420, and thus the developing roller 1042 is in contact with the photoreceptor 1052. Further, when the pressing unit 420 is positioned at the release position P2, pressure on the developing unit 1041 by the pressing unit 420 is released, and thus the developing roller 1042 is separated from the photoreceptor 1052.

The operating unit 450 is rotatably provided and provided such that the pressing unit 420 operates by the operation of the operating unit 450. That is, the at least one pressing unit 420 operates in linkage with the operating unit 450.

The operating unit 450 may include an operating body 453 connected to the rotating shaft 410 and provided to be capable of rotating about the rotating shaft 410.

The operating unit 450 may move between an operating position O1 at which a pressing force of the pressing unit 420 is generated, and a standby position O2 at which the pressing force is released.

When the operating unit 450 is positioned at the operating position O1, the pressing unit 420 is in a state in which the developing unit 1041 is pressed, and when the operating unit 150 is positioned at the standby position O2, the pressing unit 420 is in a state in which pressure on the developing unit 1041 is released.

The pressing unit 420 includes a pressing part 440 and a direction controller 430.

The pressing part 440 is provided to generate a pressing force, and a direction controller 430 is provided to change a direction of the pressing force of the pressing part 440.

The pressing part 440 includes a pressing body 442 and a pressing elastic member 446.

The pressing body 442 is provided to press the developing unit 1041. The pressing body 442 is disposed perpendicular to a longitudinal direction of the rotating shaft 410. A pressing surface 442*b* is provided in front of the pressing body 442, and the pressing surface 442*b* is in direct contact with the developing unit 1041 to press the developing unit 1041.

One side of the rotating shaft 410 is provided to pass through the pressing body 442. In detail, the pressing body 442 includes a through-hole 442*a* through which the rotating shaft 410 passes, and the pressing body 442 is rotated independently from the rotating shaft 410.

The pressing elastic member 446 provides an elastic force of the pressing body 442 to press the developing unit 1041. The pressing elastic member 446 is provided with one end thereof supporting an inner side surface of the pressing body 442 and the other end supporting the rotating shaft 410 in a direction perpendicular to a longitudinal direction of the rotating shaft 410.

Both side surfaces of the pressing body 442 are opened, and provided to be movable in a direction perpendicular to a longitudinal direction of the rotating shaft 410 with respect to the rotating shaft 410. In detail, a pressing space 443 in which the pressing elastic member 446 is disposed, and a clearance 444 changed according to tension and compression of the pressing elastic member 446 are formed inside the pressing body 442. That is, when the pressing elastic member 446 is compressed, the pressing space 443 is decreased and the clearance 444 is increased, and when the pressing elastic member 446 returns, the pressing space 443 is increased and the clearance 444 is decreased.

The direction controller 430 is provided to control a direction of the pressing part 440 according to rotation of the rotating shaft 410.

The direction controller 430 extends from the rotating shaft 410 in a direction perpendicular to an axial direction thereof, and is rotated in the same direction as the rotating shaft 410. The direction controller 430 may be integrally formed with the rotating shaft 410 and vertically inserted into the rotating shaft 410.

The pressing part 440 includes a direction guide part 448 to guide a direction by the direction controller 430.

The direction guide part 448 serves as medium for the pressing body 442 and the direction controller 430. The change of a position of the direction controller 430 is delivered to the pressing body 442 to change a direction of a pressing force of the pressing body 442.

The direction guide part 448 is provided to cover at least part of the pressing body 442. The direction guide part 448 includes a direction guide surface 448*a* guided a direction by the direction controller 430. A pair of direction guide surfaces 448*a* may be provided in a circumferential direction of the rotating shaft 410 with respect to the direction controller 430. An inserting space 448*b*, in which the direction controller 430 is inserted, is formed between the pair of direction guide surfaces 448*a*. Accordingly, when the direction controller 430 is rotated by rotation of the rotating shaft 410, one of the pair of direction guide surfaces 448*a* is guided and the pressing part 440 may be rotated.

The operating unit 450 includes a rotating body 451 and an operating member 452 which operates the rotating body 451.

The rotating body 451 is rotated together with the rotating shaft 410 and the operating member 452 is rotatably provided with respect to the rotating shaft 410 to rotate the rotating body 451.

The rotating body 451 is rotated together with the rotating shaft 410 at an end portion of the rotating shaft 410. The rotating body 451 is provided to protrude perpendicular to an axial direction of the rotating shaft 410. A fixing member 451*a* is provided on the rotating body 451 so that the rotating body 451 is rotated together with the rotating shaft 410.

The operating member 452 is provided to rotate the rotating body 451.

The operating member 452 includes an operating body 453, a unit pressing part 454, and a rotating guide part 456.

The operating body 453 is disposed perpendicular to the rotating shaft 410 and adjacent to the rotating body 451. The operating body 453 is integrally formed with the rotating shaft 410 to rotate together with rotation of the rotating shaft 410, but in the embodiment of the present invention, the operating body 453 guides rotation of the rotating body 451 and the rotating shaft 410 integrally formed with the rotating body 451 is also rotated. That is, the operating body 453 is rotated independently from the rotating shaft 410, and a hole is formed therein and the rotating shaft 410 passes through the hole.

In relation to a cover unit 470, the operating body 453 is provided to change mountability of the cover unit 470 according to a pressing state of the developing unit 1041.

The unit pressing part 454 is provided on the operating body 453 to press the photosensitive unit 1050. In detail, the unit pressing part 454 is disposed on an end portion of the operating body 453 and disposed such that the unit pressing part 454 presses the photosensitive unit 1050 when the operating unit 450 is positioned at the operating position O1. The unit pressing part 454 is formed to protrude more than the adjacent operating body 453 and a unit pressurized part 1058, which is concavely formed and corresponds to the pressing part 440, is disposed on the photosensitive unit 1050. Since the unit pressing part 454 is mounted on the unit pressurized part 1058, the photosensitive unit 1050 is prevented from detaching in the detachment direction W1*b*.

The rotating guide part 456 is disposed on the operating body 453 in a direction of a center of rotation, and provided to guide rotation of the rotating body 451. The rotating guide part 456 and the rotating body 451 are spaced a certain interval from each other, and after the operating body 453 is rotated to a predetermined angle, the rotating guide part 456 is in contact with the rotating body 451 to transfer a rotating force. Accordingly, an angle to which the operating body 453 is rotated is greater than an angle to which the rotating body 451 is actually rotated. According to an increase in the angle to which the operating body 453 is rotated, in a configuration linked with mountability of the cover unit 470 described below, the possibility of malfunction can be reduced. The interval between the rotating body 451 and the rotating guide part 456 is not limited, and the interval may vary based on factors such as a size of an image forming apparatus, a position of the developing device 1040, etc.

The rotating guide part 456 includes an operation rotating guide part 456*a* and a standby rotating guide part 456*b*.

When the operating unit 450 moves from the standby position O2 to the operating position O1, the operation rotating guide part 456*a* presses the rotating body 451 to move the pressing unit 420 to the pressing position P1. Meanwhile, when the operating unit 450 moves from the operating position O1 to the standby position O2, the standby rotating guide part 456*b* reversely presses the rotating body 451 to move the pressing unit 420 to the release position P2. A pair of operation rotating guide part 456*a* and the standby rotating guide part 456*b* may be provided on the operating body 453 within a radius of rotation of the rotating body 451.

The cover unit 470 may be detachably provided on one side of the developing device 1040. The mountability of the cover unit 470 may be determined according to a position of the operating unit 450. In detail, the cover unit 470 may be mounted only when the operating unit 450 is positioned at the operating position O1.

The cover unit 470 includes a cover body 472 and an operation inserting part 474.

The cover body 472 is provided to cover one side of the developing device 1040, and connected to the developing device 1040 to store waste toner generated from the developing device 1040.

The operation inserting part 474 is concavely formed in the cover body 472 for insertion of the operating body 453 of the operating unit 450. The operation inserting part 474 is inserted only when the operating unit 450 is positioned at the operating position O1. That is, the operation inserting part 474 is provided for insertion of the operating body 453 only when the operating unit 450 is disposed at the operating position O1 and the pressing unit 420 is positioned at the pressing position P1. The operation inserting part 474 corresponds to the operating body 453, so that the operating body 453 can be inserted only when the operating unit 450 is positioned at the operating position O1.

The operation inserting part 474 may be more concavely formed than the adjacent cover body 472, and when the operating unit 450 is disposed at a position other than the operating position O1, the cover body 472 interferes with the operating body 453, and thus the cover unit 470 is not mounted on the developing device 1040.

Hereinafter, an operation of the image forming apparatus according to the fourth embodiment of the present invention will be described.

FIGS. 27A and 27B are views illustrating mountability with respect to the developing device of the cover unit based on the operation of the pressing assembly according to the fourth embodiment of the present invention.

After the developing device 1040 is mounted on the developing device mounting part 1005, the developing unit 1041 and the photosensitive unit 1050 have to adhere to each other so that the developing roller 1042 and the photoreceptor 1052 come in contact with each other in order to perform a printing operation.

The pressing assembly 400 is operated to adhere the developing unit 1041 and the photosensitive unit 1050 to each other.

The operating unit 450 is positioned at the standby position O2 in an initial state, and the operating unit 450 is rotated so that the pressing unit 420 presses the developing unit 1041 when the developing device 1040 is mounted on the developing device mounting part 1005.

To rotate the operating unit 450 from the standby position O2 to the operating position O1, the operating body 453 is rotated. Since the operating body 453 is rotated, an operation rotating guide part 456*a* among the rotating guide part 456 of the operating body 453 presses the rotating body 451, and the rotating body 451 and the rotating shaft 410 are rotated. The rotating shaft 410 is rotated together with the direction controller 430 of the pressing unit 420. By this operation, a direction of a pressing force generated from the pressing part 440 is adjusted to press the developing unit 1041. That is, the pressing unit 420 is moved to the pressing position P1.

When the operating unit 450 is positioned at the operating position O1, the unit pressing part 454 of the operating body 453 is mounted on the unit pressurized part 1058 of the photosensitive unit 1050, and thus detachment of the photosensitive unit 1050 is prevented. When the operating unit 450 is positioned at the operating position O1, the operating body 453 may be inserted into the operation inserting part 474 of the cover unit 470, and thus the cover unit 470 may be mounted on the developing device 1040.

To move the operating unit 450 from the operating position O1 to the standby position O2, the operating body 453 is reversely rotated. Since the operating body 453 is rotated, a standby rotating guide part 456*b* among the rotating guide part 456 of the operating body 453 reversely presses the rotating body 451, and the rotating body 451 and the rotating shaft 410 are rotated. The rotating shaft 410 is rotated together with the direction controller 430 of the pressing unit 420. By this operation, a direction generated from the pressing part 440 is adjusted to release pressure on the developing unit 1041. That is, the pressing unit 420 is moved to the release position P2.

When the operating unit 450 is positioned at the standby position O2, the unit pressing part 454 of the operating body 453 is separated from the unit pressurized part 1058 of the photosensitive unit 1050, and thus the developing device 1040 is in a state in which the developing device 1040 may be separated from the developing device mounting part 1005. When the operating unit 450 is positioned at the standby position O2, the cover body 472 interferes with the operating body 453, and thus the cover unit 470 is not mounted on the developing device 1040. Thus, even when the developing roller 1042 is separated from the photoreceptor 1052, the image forming apparatus is operated and generation of problems and malfunction can be prevented. That is, operability of the image forming apparatus can be determined based on mountability of the cover unit 470, and thus problems and malfunction can be prevented in advance.

Although a few embodiments of the present invention have been shown and described, it would be appreciated by those skilled in the art that changes may be made in these embodiments without departing from the principles and spirit of the invention, the scope of which is defined in the claims and their equivalents.

In addition, these embodiments of the present invention are not exclusive or independent and may be complementary to one another. For example, an operating unit of an image forming apparatus of the second embodiment may be used in an image forming apparatus of the first embodiment, and a shutter unit of the image forming apparatus of the first embodiment may be used in the image forming apparatus of the second embodiment.

The invention claimed is:

1. An image forming apparatus comprising:

a developing device including, a photosensitive unit having a photoreceptor, and a developing unit having a developing roller to contact and separate from the photoreceptor;

a shutter unit to open or close a window through which a light is to be applied onto the photoreceptor;

a pressing assembly including, a pressing unit coupled to the shutter unit, and an operating unit provided in linkage with the pressing unit to be movable between, an operating position to press the developing unit to cause the developing roller separated from the photoreceptor to contact the photoreceptor, and cause the shutter unit to open the window, and a release position to cause the developing roller in contact with the photoreceptor to separate from the photoreceptor, and cause the shutter unit to close the window.

2. The image forming apparatus according to claim 1, wherein the developing unit includes a plurality of developing units, the photosensitive unit includes a plurality of photosensitive units and the window includes a plurality of windows corresponding to the plurality of photosensitive units, the shutter unit includes a plurality of shutter units corresponding to the windows and movable to open or close the windows, and the pressing unit includes a plurality of pressing units coupled to corresponding shutter units and each pressing unit disposed to be spaced apart along in a longitudinal direction corresponding to the plurality of developing units to press or release the corresponding developing unit, and to open or close the windows together.

3. The image forming apparatus according to claim 1, further comprising a cover unit detachably provided for the developing device, the cover unit including a guide rib to guide operation of the pressing assembly in response to attachment and detachment of the cover unit.

4. The image forming apparatus according to claim 1, wherein:

each pressing unit of the plurality of pressing units includes a pressing elastic member which generates a pressing force at the operating position.

5. The image forming apparatus according to claim 1, wherein the pressing unit includes, a pressing body to press the developing unit to cause the developing roller to contact the photoreceptor when the operating unit is at the operating position, and a pressing part having a shutter guide protrusion provided on the pressing body to move the shutter unit when the operating unit is at the operating position.

6. The image forming apparatus according to claim 5, wherein the shutter unit includes, a shutter body which corresponds to the window and provided to rotate about a shutter rotating part in a longitudinal direction of the shutter body, the shutter body including a shutter protrusion corresponding to the shutter guide protrusion of the pressing part to move the shutter body when the operating unit is at the operating position.

7. The image forming apparatus according to claim 1, further comprising a rotatable shaft coupled to the operating unit to form a center of rotation when moving the operating unit, wherein the pressing is disposed on the rotatable shaft.

8. The image forming apparatus according to claim 1, further comprising a rotatable shaft which forms a center of rotation of the operating unit, wherein the pressing unit includes:

a link unit to convert a rotational motion of the rotatable shaft by rotation of the operating unit into a linear motion; and a pressing part connected to the link unit to press the developing device.

9. The image forming apparatus according to claim 8, wherein the link unit includes:

a first link member to be rotated with the rotatable shaft; and a second link member having one end connected to an end portion of the first link member, and other end performing a linear reciprocating motion.

10. The image forming apparatus according to claim 9, wherein the link unit includes a pressing elastic member provided on the second link member to generate a pressing force of the pressing unit.

11. The image forming apparatus according to claim 10, wherein the second link member includes:

a hook inserting part, at least a part of which is inserted into the pressing part according to a position of the pressing unit; and a flexible mounting part disposed adjacent to the hook inserting part, the flexible mounting part to mount the pressing elastic member and change a length of the pressing elastic member to change in linkage with an elastic pressing force of the pressing elastic member.

12. The image forming apparatus according to claim 10, wherein one end of the pressing elastic member is supported by an end portion of the second link member and another end of the pressing elastic member is supported by the pressing part.

13. The image forming apparatus according to claim 10, wherein the pressing elastic member is compressed to a maximum compression length (ML) when the operating unit is disposed between the operating position and the standby position.

14. The image forming apparatus according to claim 1, wherein the operating unit restricts movement of the developing device in the longitudinal direction along the developing unit at the operating position.

15. The image forming apparatus according to claim 1, further comprising a developing device mounting part on which the photosensitive unit and the developing unit are mounted and into which the photosensitive unit and the developing unit are inserted in a longitudinal direction of the developing device mounting part, wherein the operating unit and the pressing unit are disposed on the developing device mounting part.

16. The image forming apparatus according to claim 1, wherein the shutter unit includes a shutter body which corresponds to the window and is provided to be capable of rotating about a shutter rotating part formed in a longitudinal direction of the shutter body.

17. The image forming apparatus according to claim 16, wherein:

the shutter unit includes an open position at which the window is opened, and a closed position at which the window is closed; and the shutter body is rotated in an acute angle between the open position and the closed position.

18. The image forming apparatus according to claim 17, wherein the shutter unit is moved from the closed position to the open position by the pressing unit and moved from the open position to the closed position by a weight of the shutter body.

19. An image forming apparatus comprising:

a developing device including, a photosensitive unit having a photoreceptor, and a developing unit having a developing roller to contact or separate from the photoreceptor;

a pressing assembly including, a rotatable shaft, a pressing unit coupled to the rotatable shaft, the pressing unit including a linking part and a pressing part, the linking part to convert a rotating motion of the rotatable shaft into a linear motion to cause the pressing part to provide a press or a release of the press, and an operating unit coupled to the rotatable shaft and rotatable to rotate the rotatable shaft, to thereby cause the linking part to convert the rotating motion of the rotatable shaft into the linear motion, the rotating motion being between, an operating position to cause the pressing part to press the developing unit to cause the developing roller separated from the photoreceptor to contact the photoreceptor, and a release position to cause the pressing part to release the press to cause the developing roller in contact with the photoreceptor to separate from the photoreceptor.

20. An image forming apparatus comprising:

a developing device including, a photoreceptor on which an electrostatic latent image is to be formed, and a developing roller to contact the photoreceptor, to supply a developer, and to be detachable from the photoreceptor;

a shutter unit to rotate to open or close a window through which a light is to be applied onto the photoreceptor;

a movable pressing unit coupled to the shutter unit and movable to press the developing roller separated from the photoreceptor to contact the photoreceptor and guide a rotation of the shutter unit to open the window, or release the developing roller in contact with the photoreceptor to separate from the photoreceptor and guide a rotation of the shutter unit to close the window; and a cover unit to couple to a side of the developing device to press the pressing unit to link with the shutter unit to rotate the shutter unit to open the window, and detach from the side of the developing device to unlink from the pressing unit to cause rotation of the shutter unit to close the window.

* * * * *